US009697762B2

(12) United States Patent
Morita

(10) Patent No.: US 9,697,762 B2
(45) Date of Patent: Jul. 4, 2017

(54) DRIVER AND ELECTRONIC DEVICE

(71) Applicant: SEIKO EPSON CORPORATION, Tokyo (JP)

(72) Inventor: Akira Morita, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/870,555

(22) Filed: Sep. 30, 2015

(65) Prior Publication Data

US 2016/0111038 A1 Apr. 21, 2016

(30) Foreign Application Priority Data

Oct. 15, 2014 (JP) ..... 2014-210365

(51) Int. Cl.
*G09G 3/20* (2006.01)
*G09G 3/36* (2006.01)

(52) U.S. Cl.
CPC ..... *G09G 3/2092* (2013.01); *G09G 3/3688* (2013.01); *G09G 3/3696* (2013.01); *G09G 2310/027* (2013.01); *G09G 2310/0291* (2013.01); *G09G 2330/028* (2013.01)

(58) Field of Classification Search
CPC ..... G09G 2310/08; G09G 2300/0426; G09G 2330/021
See application file for complete search history.

(56) References Cited

U.S. PATENT DOCUMENTS 6,101,102 A * 8/2000 Brand ..... H02M 1/12 257/E27.049
6,307,681 B1 * 10/2001 Aoki ..... G09G 3/3648 340/14.1
6,420,988 B1 * 7/2002 Azami ..... G09G 3/3275 341/144
6,486,812 B1 * 11/2002 Tanaka ..... H03M 1/68 341/136
6,606,045 B2 8/2003 Azami et al.
7,436,385 B2 * 10/2008 Kim ..... G09G 3/3655 345/98

(Continued)

FOREIGN PATENT DOCUMENTS

JP 2000-341125 A 12/2000
JP 2001-156641 A 6/2001

(Continued)

OTHER PUBLICATIONS

Apr. 20, 2017 Office Action issued in U.S Appl. No. 14/876,377.

*Primary Examiner* — Andrew Sasinowski
*Assistant Examiner* — Chun-Nan Lin
(74) *Attorney, Agent, or Firm* — Oliff PLC

(57) ABSTRACT

In a display device including a driver that drives load lines in an electro-optical panel through capacitor charge redistribution, load capacitance among the load lines of the electro-optical panel differs depending on parasitic capacitance of a board on which the load lines are mounted, the type of the panel, and so on, and the accuracy of driving voltages drops due to such variations. The driver is provided with a adjusting capacitance group that corrects variation in load capacitance, and by adjusting a driving capacitance on the driver side, a ratio with the load capacitance is increased and accuracy of a post-driving potential is increased.

20 Claims, 15 Drawing Sheets

(56) References Cited

U.S. PATENT DOCUMENTS

| | | | | |
|---|---|---|---|---|
| 8,400,439 | B2 | 3/2013 | Morita | |
| 8,780,103 | B2 * | 7/2014 | van Veenendaal ..... | G09G 3/344 345/212 |
| 2005/0168416 | A1 | 8/2005 | Hashimoto et al. | |
| 2005/0206598 | A1 | 9/2005 | Yamazaki et al. | |
| 2009/0066615 | A1 * | 3/2009 | Kawasaki ..... | G09G 3/3233 345/77 |
| 2011/0205481 | A1 * | 8/2011 | Aruga ..... | G09G 3/3648 349/151 |
| 2015/0049073 | A1 | 2/2015 | Morita | |

FOREIGN PATENT DOCUMENTS

| | | | |
|---|---|---|---|
| JP | 2010-102080 | A | 5/2010 |
| JP | 2010-181506 | A | 8/2010 |
| JP | 2015-036757 | A | 2/2015 |
| JP | 2015-038543 | A | 2/2015 |

* cited by examiner

FIG. 2A RESET
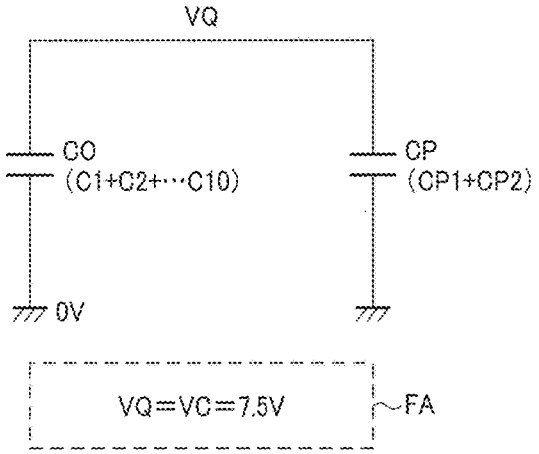
FIG. 2B MAXIMUM DATA VOLTAGE
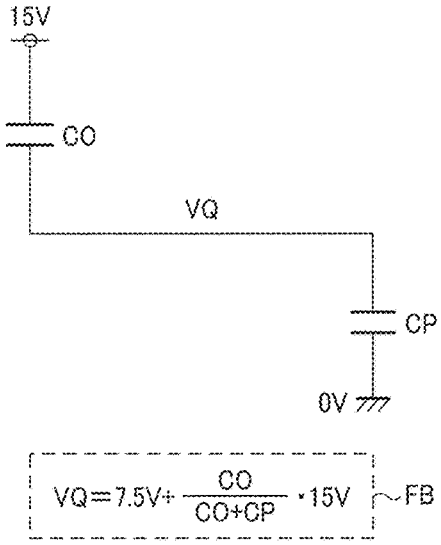
FIG. 2C
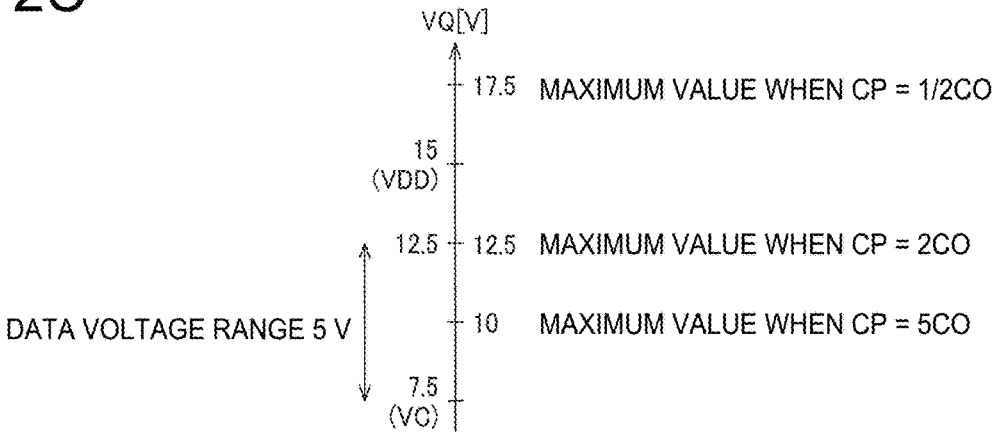

$$VQ = 7.5V + 5V \times \frac{2^9 \times GD10 + 2^8 \times GD9 + \cdots + 2^0 \times GD1}{2^9 + 2^8 + \cdots + 2^0}$$

$$= 7.5V + 5V \times \frac{512 \times GD10 + 256 \times GD9 + \cdots + 1 \times GD1}{1023}$$

FE

FIG. 9A (S8:NO)
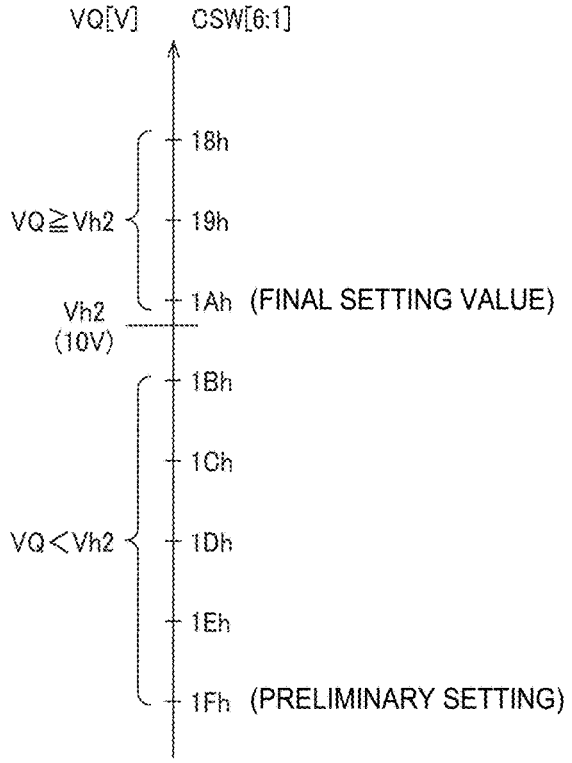
FIG. 9B (S8:YES)
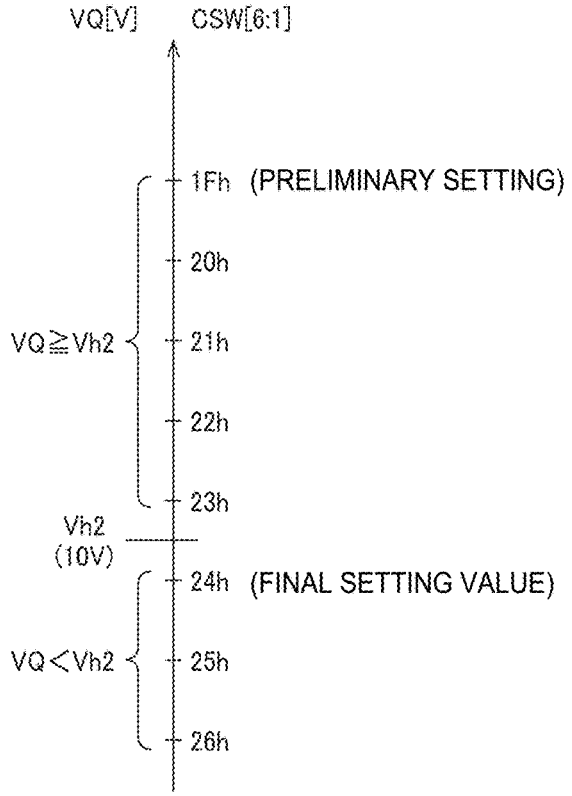

DRIVER AND ELECTRONIC DEVICE

BACKGROUND

1. Technical Field

The present invention relates to drivers, electronic devices, and the like.

2. Related Art

Display devices (liquid-crystal display devices, for example) are used in a variety of electronic devices, including projectors, information processing apparatuses, mobile information terminals, and the like. Increases in the resolutions of such display devices continue to progress, and as a result, the time a driver drives a single pixel is becoming shorter. For example, phase expansion driving is used as a method for driving an electro-optical panel (a liquid-crystal display panel, for example). According to this driving method, for example, eight source lines are driven at one time, and the process is repeated 160 times to drive 1,280 source lines. In the case where a WXGA (1,280×768 pixels) panel is to be driven, the stated 160 instances of driving (that is, the driving of a single horizontal scanning line) is thus repeated 768 times. Assuming a refresh rate of 60 Hz, a simple calculation shows that the driving time for a single pixel is approximately 135 nanoseconds. In actuality, there are periods where pixels are not driven (blanking intervals and the like, for example), and thus the driving time for a single pixel becomes even shorter, at approximately 70 nanoseconds.

Past drivers for driving such electro-optical panels have included D/A conversion circuits for converting tone data (image data) of each pixel into data voltages and amplifier circuits that drive the pixels with the data voltages. This is done in order for the amplifier circuits to carry out impedance conversion and supply charges for capacitance on the electro-optical panel side (parasitic capacitance of interconnects, pixel capacitance, and the like, for example). In other words, past drivers have been configured to be capable of supplying only the required charges at the required magnitudes in order to write the data voltages.

JP-A-2000-341125 and JP-A-2001-156641 are examples of related art.

However, with the increases in resolutions of electro-optical panel as mentioned above, it is becoming difficult for the amplifier circuits to finish writing the data voltages within the required time. For example, in the above WXGA example, it is necessary for the writing for a single pixel to finish within 70 nanoseconds, and thus the write time becomes even shorter if an attempt to further increase the resolution is made. For the amplifier circuits to drive the pixels at high speeds, it is necessary to have a wide output range corresponding to the range of the data voltages, and to be able to supply the charges at a high speed at any voltage within that output range. Achieving both requires, for example, an increase in the bias voltage of the amplifier circuits, resulting in a further increase in power consumption in drivers as increases in resolution progress.

A method that drives an electro-optical panel through capacitor charge redistribution (called "capacitive driving" hereinafter) can be considered as a driving method for solving such problems. For example, JP-A-2000-341125 and JP-A-2001-156641 disclose techniques that use capacitor charge redistribution in D/A conversion. In a D/A conversion circuit, both driving-side capacitance and load-side capacitance are included in an IC, and charge redistribution occurs between those capacitances. The internal capacitance values are fixed, and thus the same D/A conversion result is always obtained. For example, assume such a load-side capacitance of the D/A conversion circuit is replaced with the capacitance of the electro-optical panel external to the IC and used as a driver. In this case, charge redistribution occurs between the driver-side capacitance and the electro-optical panel-side capacitance.

However, the charge supplied to the electro-optical panel-side capacitance due to the charge redistribution depends on the magnitude of the electro-optical panel-side capacitance. In other words, it is not necessarily the case that the required charge will be supplied at the required magnitudes as in the case where amplifier circuits are used. Accordingly, there is a problem in that output voltages will vary depending on a connection environment of the driver (the type of the electro-optical panel connected to the driver, the design of a printed circuit board on which the driver is mounted, and so on, for example).

SUMMARY

An advantage of some aspects of the invention is to provide a driver, an electronic device, and so on that realize capacitive driving generally applicable in a variety of connection environments.

One aspect of the invention concerns a driver including a capacitor driving circuit that outputs first to nth capacitor driving voltages (where n is a natural number of 2 or more) corresponding to tone data to first to nth capacitor driving nodes, a capacitor circuit including first to nth capacitors provided between the first to nth capacitor driving nodes and a data voltage output terminal, and a variable capacitance circuit provided between the data voltage output terminal and a reference voltage node; a capacitance of the variable capacitance circuit is set so that a capacitance obtained by adding a capacitance of the variable capacitance circuit and an electro-optical panel-side capacitance is in a prescribed capacitance ratio relationship with a capacitance of the capacitor circuit.

According to this aspect of the invention, the capacitance of the variable capacitance circuit is set so that the capacitance obtained by adding the capacitance of the variable capacitance circuit and the electro-optical panel-side capacitance is in the prescribed capacitance ratio relationship with the capacitance of the capacitor circuit. Accordingly, even if the electro-optical panel-side capacitance is different, the prescribed capacitance ratio relationship can be realized by adjusting the capacitance of the variable capacitance circuit in accordance therewith, and a desired data voltage range that corresponds to that capacitance ratio relationship can be realized. In this manner, capacitive driving generally applicable in a variety of connection environments can be realized.

According to another aspect of the invention, the capacitor driving circuit may output a first voltage level or a second voltage level as each driving voltage of the first to nth capacitor driving voltages based on first to nth bits of the tone data; and the prescribed capacitance ratio relationship may be determined by a voltage relationship between a voltage difference between the first voltage level and the second voltage level and the data voltages outputted to the data voltage output terminal.

Through this, the prescribed capacitance ratio relationship can be determined from the voltage relationship between the voltage difference between the first voltage level and the second voltage level and the data voltage outputted to the data voltage output terminal. In other words, even if the electro-optical panel-side capacitance is not known, the capacitance of the variable capacitance circuit at which the prescribed capacitance ratio relationship can be realized can be determined from the voltage relationship.

According to another aspect of the invention, the driver may further include a detection circuit that detects a voltage at the data voltage output terminal, and the capacitance of the variable capacitance circuit may be set based on a detection result from the detection circuit.

Through this, the data voltage outputted to the data voltage output terminal can be detected, and whether or not the voltage relationship that achieves the prescribed capacitance ratio relationship can be determined based on that detection result. Then, the capacitance of the variable capacitance circuit that realizes the prescribed capacitance ratio relationship can be determined based on a result of that determination.

According to another aspect of the invention, the variable capacitance circuit may include first to mth adjusting capacitors (where m is a natural number of 2 or more) and first to mth switching elements provided between the first to mth adjusting capacitors and the data voltage output terminal.

Through this, connecting and disconnecting between the first to mth adjusting capacitors and the data voltage output terminal can be controlled by controlling the first to mth switching elements to turn on or off. As a result, the capacitance of the variable capacitance circuit can be set by turning the first to mth switching elements on or off.

According to another aspect of the invention, in a reset period prior to capacitive driving that drives the electro-optical panel using the capacitor driving circuit and the capacitor circuit, the data voltage output terminal may be set to a prescribed reset voltage, in a state in which the first to nth capacitor driving voltages corresponding to initial value data of the capacitor driving circuit are outputted.

Through this, by setting the reset voltage for the initial value data, a charge corresponding to that reset voltage is accumulated in a node of the data voltage output terminal. As a result, by associating the initial value data with the reset voltage and conserving the charge in the node of the data voltage output terminal thereafter, a data voltage corresponding to the tone data using the reset voltage as a reference can be outputted.

According to another aspect of the invention, the driver may further include a reset voltage amplifier circuit or a reset voltage terminal for setting the prescribed reset voltage.

Although capacitive driving basically assumes that no charge is supplied from the exterior in order to conserve the charge at the node of the data voltage output terminal, when carrying out a reset, it is necessary to supply a charge from the exterior to carry out the reset. According to this aspect of the invention, a charge is supplied from the reset voltage terminal or the reset voltage amplifier circuit, and thus the charge at the node of the data voltage output terminal can be reset.

According to another aspect of the invention, reset operations in the reset period may be carried out in the case where data lines of the electro-optical panel are driven by driving aside from capacitive driving.

In the case where data lines in an electro-optical panel are driven by driving aside from capacitive driving, charges are supplied to the data lines through that driving. In other words, the charge conservation at the node of the data voltage output terminal breaks down, and the initial value data and the reset voltage no longer correspond to each other. According to this aspect of the invention, by carrying out reset operations in the case where the data lines of the electro-optical panel are driven by driving aside from capacitive driving, the initial value data and the reset voltage can be associated with each other, and a data voltage that uses the reset voltage as a reference can be outputted.

According to another aspect of the invention, the driving aside from capacitive driving may be precharge driving that outputs a prescribed precharge voltage to the data lines.

Furthermore, according to another aspect of the invention, the driver may further include a precharge amplifier circuit that carries out the precharge driving, and a precharge terminal, connected to an output of the precharge amplifier circuit, for connecting an external capacitor.

In this manner, in precharge driving, the data lines are driven at a precharge voltage that is different from the reset voltage, and the charge conservation at the node of the data voltage output terminal will break down. According to this aspect of the invention, a reset is carried out after the precharge driving, and thus the output of a data voltage that uses the reset voltage as a reference can be started.

According to another aspect of the invention, charge redistribution may be carried out among a capacitance of the first to nth capacitors, the capacitance of the variable capacitance circuit, and the electro-optical panel-side capacitance by the capacitor driving circuit outputting the first to nth capacitor driving voltages, and a data voltage corresponding to the tone data may be outputted to the data voltage output terminal.

The charge redistribution occurs by changing the first to nth capacitor driving voltages in a state where the node of the data voltage output terminal conserves a charge. The voltage at the data voltage output terminal is determined as a result of this charge redistribution. This voltage is determined in correspondence with the tone data, and thus the voltage at the data voltage output terminal is a data voltage corresponding to the tone data.

According to another aspect of the invention, the driver may further include first to kth data line driving circuits (where k is a natural number of 2 or more) in which each data line driving circuit has the capacitor driving circuit, the capacitor circuit, and the variable capacitance circuit, and first to kth data voltage output terminals connected to outputs of the first to kth data line driving circuits. The electro-optical panel may have first to kth data lines to be connected to the first to kth data voltage output terminals, $((j-1)\times k+1)$th to $(j\times k)$th source lines (where j is a natural number less than or equal to s, and s is a natural number of 2 or more), and $(j-1)\times k+1$ to $j\times k$th switching elements provided between the first to kth data lines and the $(j-1)\times k+1$th to $j\times k$th source lines. After first to kth switching elements (j=1) have turned on and the first to kth data line driving circuits have driven first to kth source lines, k+1th to $2\times k$th switching elements (j=2) may turn on and the first to kth data line driving circuits may drive k+1th to $2\times k$th source lines.

Through this, the electro-optical panel can be driven through phase expansion driving. Phase expansion driving can drive many source lines with few data line driving circuits, and thus the driver can be reduced in size. On the other hand, the number of instances of driving for displaying a single frame of an image increases, and thus high-speed driving is necessary. According to this aspect of the invention, high-speed driving can be realized through capacitive driving, and thus electro-optical panels having higher resolutions can be driven.

Another aspect of the invention concerns an electronic device including any of the drivers described above.

BRIEF DESCRIPTION OF THE DRAWINGS

The invention will be described with reference to the accompanying drawings, wherein like numbers reference like elements.

FIGS. 2A to 2C are diagrams illustrating data voltages in the first configuration example.

FIGS. 9A and 9B are diagrams illustrating a process for setting a capacitance of a variable capacitance circuit.

DESCRIPTION OF EXEMPLARY EMBODIMENTS

Hereinafter, preferred embodiments of the invention will be described in detail. Note that the embodiments described hereinafter are not intended to limit the content of the invention as described in the appended claims in any way, and not all of the configurations described in these embodiments are required as the means to solve the problems as described above.

1. First Example of Configuration of Driver

Figure 1:
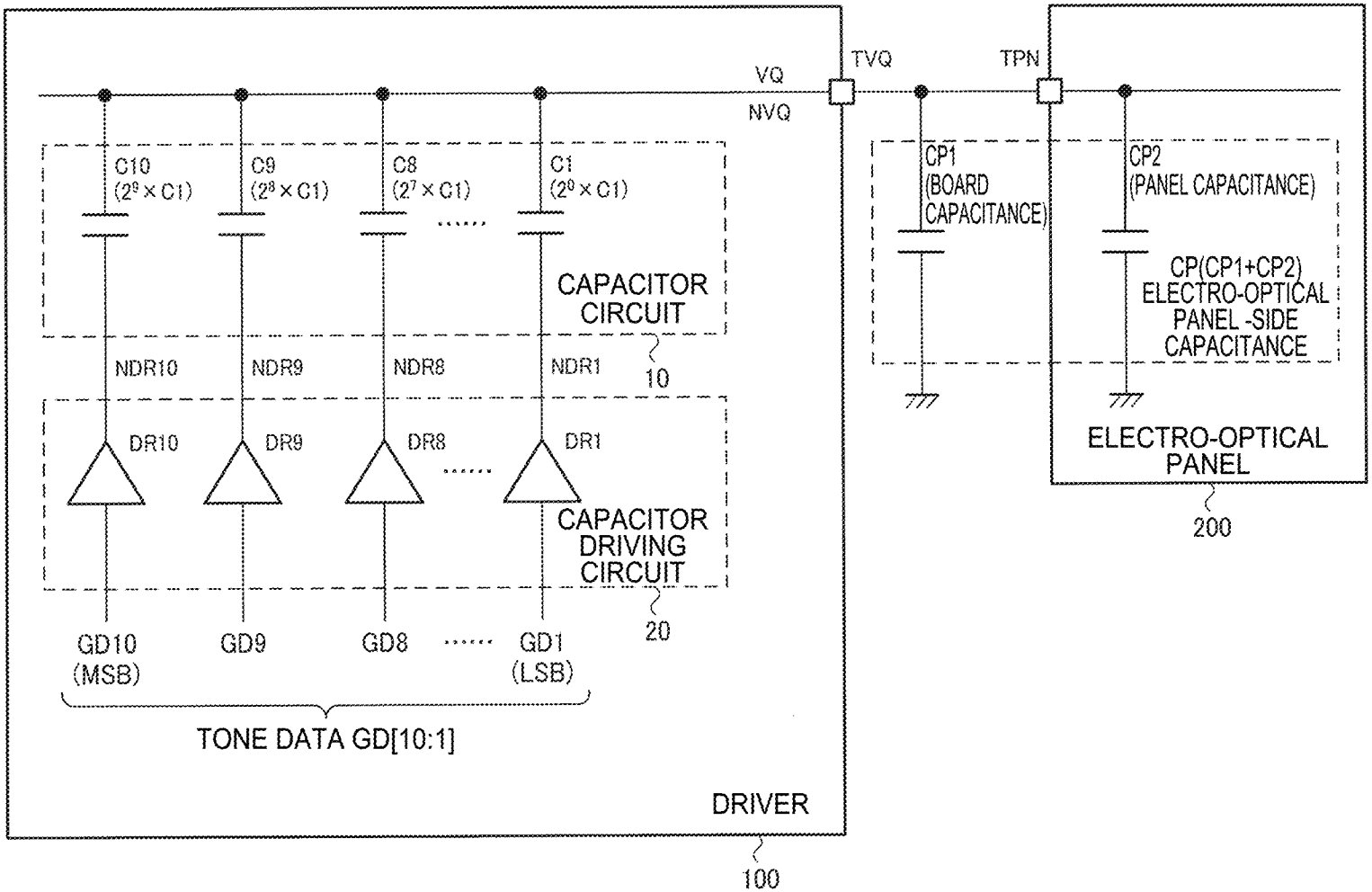
FIG. 1 illustrates a first example of the configuration of a driver.

FIG. 1 illustrates a first example of the configuration of a driver according to this embodiment. This driver 100 includes a capacitor circuit 10, a capacitor driving circuit 20, and a data voltage output terminal TVQ. Note that in the following, the same sign as a sign for a capacitor is used as a sign indicating a capacitance value of that capacitor.

The driver 100 is constituted by an integrated circuit (IC) device, for example. The integrated circuit device corresponds to an IC chip in which a circuit is formed on a silicon substrate, or a device in which an IC chip is held in a package, for example. Terminals of the driver 100 (the data voltage output terminal TVQ and so on) correspond to pads or package terminals of the IC chip.

The capacitor circuit 10 includes first to nth capacitors C1 to Cn (where n is a natural number of 2 or more). The capacitor driving circuit 20 includes first to nth driving units DR1 to DRn. Although the following describes a case where n=10 as an example, n may be any natural number greater than or equal to 2. For example, n may be set to the same number as the bit number of tone data.

One end of an ith capacitor in the capacitors C1 to C10 (where i is a natural number no greater than n, which is 10) is connected to a capacitor driving node NDRi, and another end of the ith capacitor is connected to a data voltage output node NVQ. The data voltage output node NVQ is a node connected to the data voltage output terminal TVQ. The capacitors C1 to C10 have capacitance values weighted by a power of 2. Specifically, the capacitance value of the ith capacitor Ci is $2^{(i-1)}\times C1$.

An ith bit GDi of tone data GD [10:1] is inputted into an input node of an ith driving unit DRi of the first to tenth driving units DR1 to DR10. An output node of the ith driving unit DRi corresponds to the ith capacitor driving node NDRi. The tone data GD [10:1] is constituted of first to tenth bits GD1 to GD10 (first to nth bits), where the bit GD1 corresponds to the LSB and the bit GD10 corresponds to the MSB.

The ith driving unit DRi outputs a first voltage level in the case where the bit GDi is at a first logic level and outputs a second voltage level in the case where the bit GDi is at a second logic level. For example, the first logic level is 0 (low-level), the second logic level is 1 (high-level), the first voltage level is a voltage at a low-potential side power source VSS (0 V, for example), and the second voltage level is a voltage at a high-potential side power source VDD (15 V, for example). For example, the ith driving unit DRi is constituted of a level shifter that level-shifts the inputted logic level (a 3 V logic power source, for example) to the output voltage level (15 V, for example) of the driving unit DRi, a buffer circuit that buffers the output of that level shifter, and so on.

As described above, the capacitance values of the capacitors C1 to C10 are weighted by a power of 2 that is based on the order of the bits GD1 to GD10 in the tone data GD [10:1]. The driving units DR1 to DR10 output 0 V or 15 V in accordance with the bits GD1 to GD10, and the capacitors C1 to C10 are driven by those voltages. As a result of this driving, charge redistribution occurs between the capacitors C1 to C10 and an electro-optical panel-side capacitance CP, and a data voltage is output to the data voltage output terminal TVQ as a result.

The electro-optical panel-side capacitance CP is the sum of capacitances as viewed from the data voltage output terminal TVQ. For example, the electro-optical panel-side capacitance CP is a result of adding a board capacitance CP1 that is parasitic capacitance of a printed circuit board with a panel capacitance CP2 that is parasitic capacitance, pixel capacitances, and the like within an electro-optical panel 200.

Specifically, the driver 100 is mounted on a rigid board as an integrated circuit device, a flexible board is connected to that rigid board, and the electro-optical panel 200 is connected to that flexible board. Interconnects are provided on the rigid board and the flexible board for connecting the data voltage output terminal TVQ of the driver 100 to a data voltage input terminal TPN of the electro-optical panel 200. Parasitic capacitance of these interconnects corresponds to the board capacitance CP1. Meanwhile, as will be described later with reference to FIG. 12, data lines connected to the data voltage input terminal TPN, source lines, switching elements that connect the data lines to the source lines, pixel circuits connected to the source lines, and so on are provided in the electro-optical panel 200. The switching elements are constituted by TFTs (Thin Film Transistors), for example, and there is parasitic capacitance between the sources and gates thereof. Many switching elements are connected to the data lines, and thus the parasitic capacitance of many switching elements is present on the data lines. Parasitic capacitance is also present between data lines, source lines, or the like and a panel substrate. In the liquid-crystal display panel, there is capacitance in the liquid-crystal pixels. The panel capacitance CP2 is the sum of those capacitances.

Figure 14:
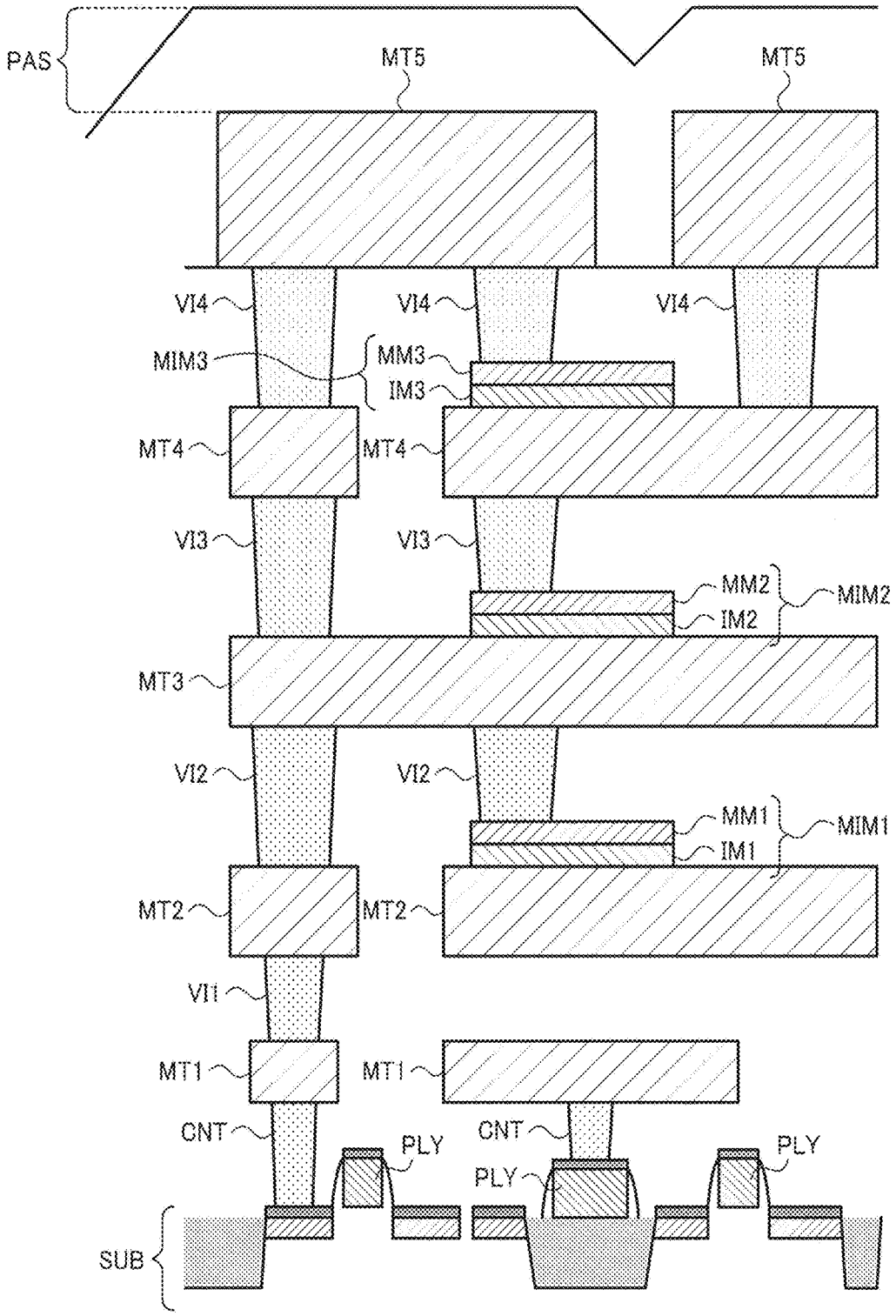
FIG. 14 is a cross-sectional view of a semiconductor substrate of a driver.

The electro-optical panel-side capacitance CP is 50 pF to 120 pF, for example. As will be described later, to ensure a ratio of 1:2 between a capacitance CO of the capacitor circuit 10 (the sum of the capacitances of the capacitors C1 to C10) and the electro-optical panel-side capacitance CP, the capacitance CO of the capacitor circuit 10 is 25 pF to 60 pF. Although large as a capacitance internal to an integrated circuit, the capacitance CO of the capacitor circuit 10 can be achieved by a cross-sectional structure that, for example, vertically stacks two to three levels of MIM (Metal Insulation Metal) capacitors, as illustrated in FIG. 14, which will be described later.

2. Data Voltages in First Configuration Example

Next, data voltages outputted by the driver 100 according to this embodiment will be described. Here, the range of data voltages will be described, and what data voltage is outputted for each individual piece of tone data GD [10:1] will be mentioned later.

As illustrated in FIG. 2A, first, the capacitor circuit 10 is reset. In other words, "000h" is set for the tone data GD [10:1] (the h at the end indicates that the number within the " " is a hexadecimal) and all of the outputs of the driving units DR1 to DR10 are set to 0 V. Meanwhile, a voltage VQ is set to VC=7.5 V, as indicated by Formula FA in FIG. 2A. In this reset, the entire charge accumulated in the capacitance CO of the capacitor circuit 10 and the electro-optical panel-side capacitance CP is conserved in the following data voltage output. Through this, data voltage that takes a reset voltage VC (a common voltage) as a reference is outputted.

As illustrated in FIG. 2B, the maximum value of the data voltage is outputted in the case where the tone data GD [10:1] is set to "3FFh" and the outputs of all of the driving units DR1 to DR10 are set to 15 V. The data voltage at this time can be found from the principle of the conservation of charge, and is a value indicated by Formula FB in FIG. 2B.

As illustrated in FIG. 2C, a desired data voltage range is assumed to be 5 V, for example. Because the reset voltage VC of 7.5 V is the reference, the maximum value is 12.5 V. This data voltage is realized when, based on the Formula FB, CO/(CO+CP)=1/3. In other words, relative to the electro-optical panel-side capacitance CP, the capacitance CO of the capacitor circuit 10 may be set to CP/2 (in other words, CP=2CO). The 5 V data voltage range can be realized by designing CO to be equal to CP/2 in this manner for a specific electro-optical panel 200 and a mounting board.

However, as mentioned above, depending on the type of the electro-optical panel 200, the design of the mounting board, and so on, the electro-optical panel-side capacitance CP has a range of approximately 50 pF to 120 pF. Meanwhile, even with the same types of electro-optical panel 200 and mounting board, in the case where a plurality of electro-optical panels are connected (when connecting three R, G, and B electro-optical panels in a projector, for example), the lengths of wires for connecting the respective electro-optical panels to drivers differ, and thus the board capacitance CP1 will not necessary be the same.

For example, assume that the design is such that the capacitance CO of the capacitor circuit 10 for a given electro-optical panel 200 and mounting board is CP=2CO. In the case where a different type of electro-optical panel or mounting board is connected to this capacitor circuit 10, CP may become CO/2, $5CO_3$ or the like. In the case where CP=CO/2, the maximum value of the data voltage will become 17.5 V, exceeding the power source voltage of 15 V, as illustrated in FIG. 2C. In this case, there is a problem not only in terms of the data voltage range but also in terms of the breakdown voltages of the driver 100, the electro-optical panel 200, and so on. Meanwhile, in the case where CP=5CO, the maximum value of the data voltage is 10 V, and thus a sufficient data voltage range cannot be achieved.

As such, in the case where the capacitance CO of the capacitor circuit 10 is set in accordance with the electro-optical panel-side capacitance CP, there is an issue that a dedicated design is necessary for the driver 100 with respect to the electro-optical panel 200, the mounting board, or the like. In other words, each time the type of the electro-optical panel 200, the design of the mounting board, or the like is changed, it is necessary to redesign the driver 100 specifically therefor.

3. Second Example of Configuration of Driver

Figure 3:
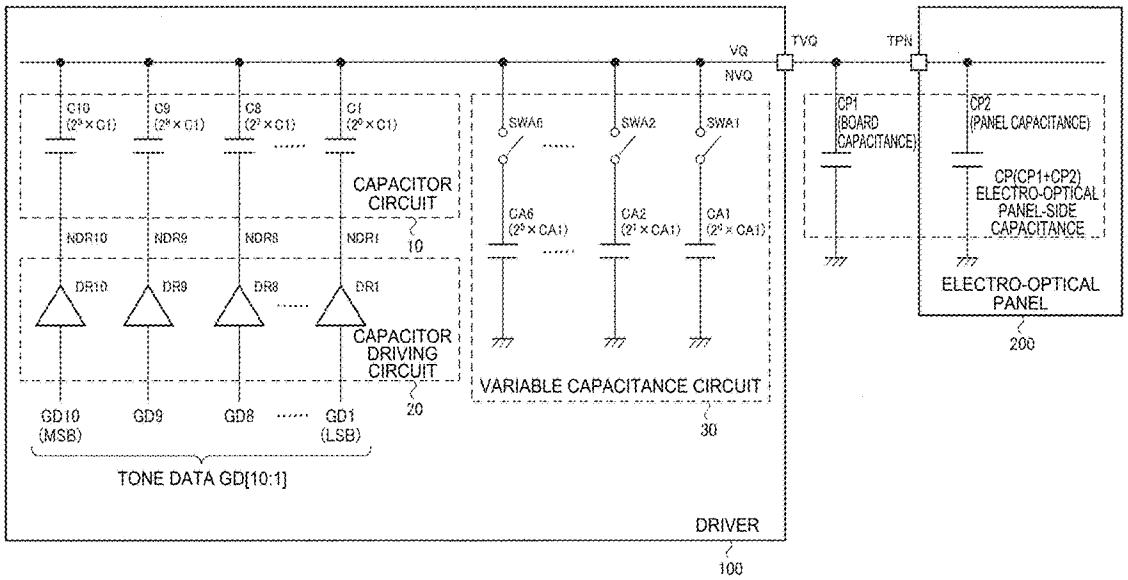
FIG. 3 illustrates a second example of the configuration of a driver.

FIG. 3 illustrates a second example of the configuration of a driver according to this embodiment, capable of solving the stated problem. This driver 100 includes the capacitor circuit 10, the capacitor driving circuit 20, and a variable capacitance circuit 30. Note that constituent elements that are the same as constituent elements already described are assigned the same reference numerals, and descriptions of those constituent elements are omitted as appropriate.

The variable capacitance circuit 30 is a circuit, serving as a capacitance connected to the data voltage output node NVQ, whose capacitance value can be set in a variable manner. Specifically, the variable capacitance circuit 30 includes first to mth switching elements SWA1 to SWAm (where m is a natural number of 2 or more), and first to mth adjusting capacitors CA1 to CAm. Note that the following will describe an example in which m=6.

The first to sixth switching elements SWA1 to SWA6 are configured as, for example, P-type or N-type MOS transistors, or as transfer gates that combine a P-type MOS transistor and an N-type MOS transistor. Of the switching elements SWA1 to SWA6, one end of an sth switching element SWAs (where s is a natural number no greater than m, which is 6) is connected to the data voltage output node NVQ.

The first to sixth adjusting capacitors CA1 to CA6 have capacitance values weighted by a power of 2. Specifically, of the adjusting capacitors CA1 to CA6, an sth adjusting capacitor CAs has a capacitance value of $2^{(s-1)}\times$CA1. One end of the sth adjusting capacitor CAs is connected to another end of the sth switching element SWAs. Another end of the sth adjusting capacitor CAs is connected to a low-potential side power source (broadly defined as a reference voltage node).

For example, in the case where CA1 is set to 1 pF, the capacitance of the variable capacitance circuit 30 is 1 pF while only the switching element SWA1 is on, whereas the capacitance of the variable capacitance circuit 30 is 63 pF (=1 pF+2 pF+ . . . +32 pF) while all the switching elements SWA1 to SWA6 are on. Because the capacitance values are weighted by a power of 2, the capacitance of the variable capacitance circuit 30 can be set from 1 pF to 63 pF in 1 pF (CA1) steps in accordance with whether the switching elements SWA1 to SWA6 are on or off.

4. Data Voltages in Second Configuration Example

Data voltages outputted by the driver 100 according to this embodiment will be described. Here, a range of the data voltages will be described.

Figure 4A:
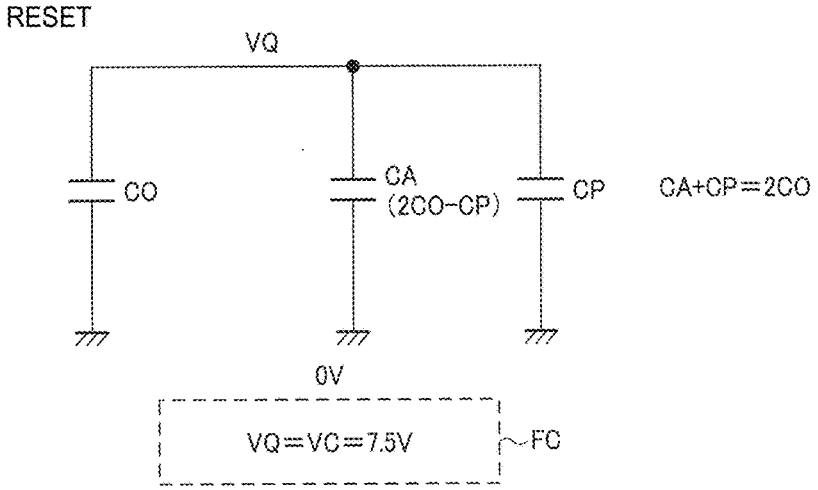
FIGS. 4A to 4C are diagrams illustrating data voltages in the second configuration example.

As illustrated in FIG. 4A, first, the capacitor circuit 10 is reset. In other words, the outputs of all the driving units DR1 to DR10 are set to 0 V and the voltage VQ is set to VC=7.5 V (Formula FC). In this reset, the entire charge accumulated in the capacitance CO of the capacitor circuit 10, a capacitance CA of the variable capacitance circuit, and the electro-optical panel-side capacitance CP is stored in the following data voltage output.

Figure 4B:
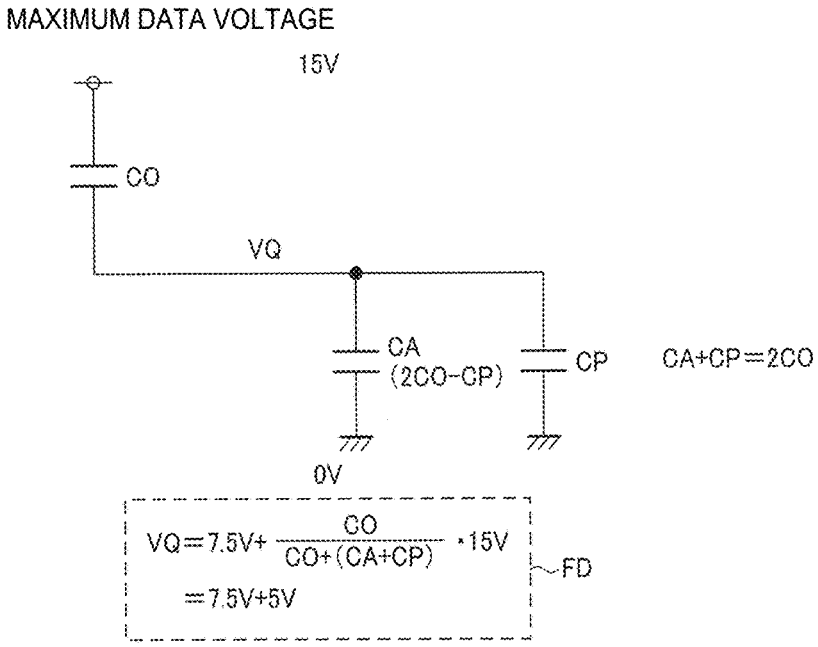

As illustrated in FIG. 4B, the maximum value of the data voltage is outputted in the case where the outputs of all of the driving units DR1 to DR10 are set to 15 V. The data voltage in this case is a value indicated by Formula FD in FIG. 4B.

Figure 4C:
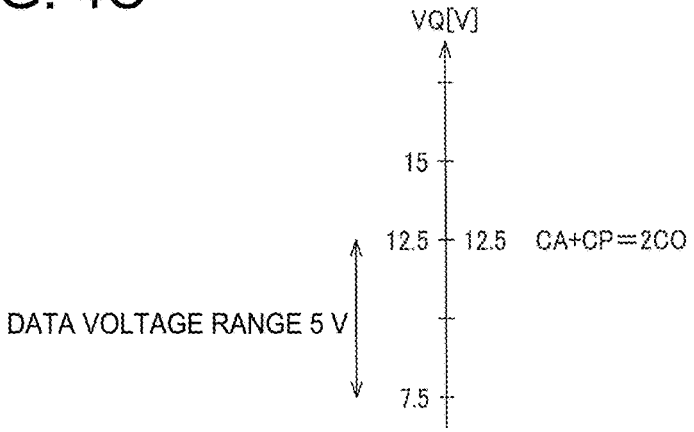

As illustrated in FIG. 4C, a desired data voltage range is assumed to be 5 V, for example. The maximum value of 12.5 V for the data voltage is realized in the case where, from Formula FD, CO/(CO+(CA+CP))=1/3, or in other words, in the case where CA+CP=2CO. CA is the capacitance of the variable capacitance circuit, and can thus be set freely, which in turn means that the CA can be set to 2CO−CP for the provided CP. In other words, regardless of the type of the electro-optical panel 200 connected to the driver 100, the design of the mounting board, or the like, the data voltage range can always be set to 7.5 V to 12.5 V.

Next, data voltages outputted by the driver 100 with respect to individual pieces of the tone data GD [10:1] will be described. It is assumed here that the capacitance of the variable capacitance circuit is set to CA=2CO−CP.

Figure 5A:
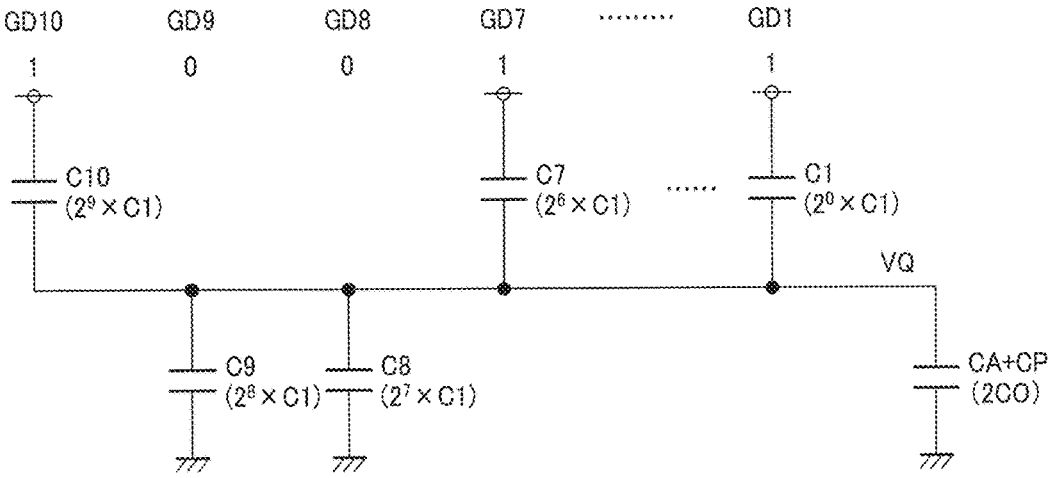
FIGS. 5A and 5B are diagrams illustrating data voltages corresponding to tone data.

As illustrated in FIG. 5A, the driving unit DRi outputs 0 V in the case where the ith bit GDi is "0", and the driving unit DRi outputs 15 V in the case where the ith bit GDi is "1". FIG. 5A illustrates an example of a case where GD[10:1]="1001111111b" (the b at the end indicates that the number within the " " is binary).

Figure 5B:
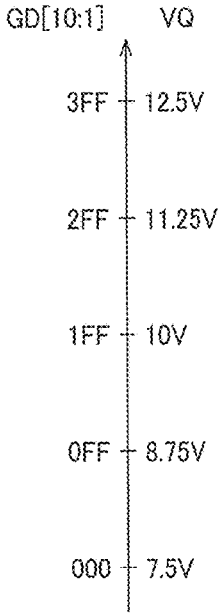

The reset is carried out in the same manner as illustrated in FIG. 4A, and based on the conservation of charge, Formula FE in FIG. 5A is found. In Formula FE, the sign GDi expresses the value of the bit GDi ("0" or "1"). Looking at the second term on the right side of Formula FE, it can be seen that the tone data GD [10:1] is converted into 1,024-tone data voltages (5 V×0/1,023, 5 V×1/1,023, 5 V×2/1,023, . . . , 5 V×1,023/1,023). FIG. 5B illustrates a data voltage (an output voltage VQ) when the most significant three bits of the tone data GD [10:1] have been changed as an example.

Although positive-polarity driving has been described as an example thus far, it should be noted that negative-polarity driving may be carried out in this embodiment. Inversion driving that alternates positive-polarity driving and negative-polarity driving may be carried out as well. In negative-polarity driving, the outputs of the driving units DR1 to DR10 in the capacitor driving circuit 20 are all set to 15 V in the reset, and the output voltage VQ is set to VC=7.5 V. The logic level of each bit in the tone data GD [10:1] is inverted ("0" to "1" and "1" to "0"), inputted into the capacitor driving circuit 20, and capacitive driving is carried out. In this case, a VQ of 7.5 V is outputted with respect to tone data GD [10:1] of "000h", a VQ of 2.5 V is outputted with respect to tone data GD [10:1] of "3FFh", and the data voltage range becomes 7.5 V to 2.5 V.

According to the second configuration example described thus far, the driver 100 includes the capacitor circuit 10, the capacitor driving circuit 20, and the variable capacitance circuit 30.

The capacitor driving circuit 20 outputs first to tenth capacitor driving voltages (0 V or 15 V), corresponding to the tone data GD [10:1], to first to tenth capacitor driving nodes NDR1 to NDR10. The capacitor circuit 10 has the first to tenth capacitors C1 to C10 provided between the first to tenth capacitor driving nodes NDR1 to NDR10 and the data voltage output terminal TVQ. The variable capacitance circuit 30 is provided between the data voltage output terminal TVQ and a node at a reference voltage (the voltage of the low-potential side power source, namely 0 V).

Then, the capacitance CA of the variable capacitance circuit 30 is set so that a capacitance CA+CP obtained by adding the capacitance CA of the variable capacitance circuit 30 and the electro-optical panel-side capacitance CP (this will be called a "driven-side capacitance" hereinafter) and the capacitance CO of the capacitor circuit 10 (this will be called a "driving-side capacitance" hereinafter) have a prescribed capacitance ratio relationship (CO:(CA+CP)=1:2, for example).

Here, the capacitance CA of the variable capacitance circuit 30 is a capacitance value set for the variable capacitance of the variable capacitance circuit 30. In the example of FIG. 3, this is obtained by taking the total of the capacitances of the adjusting capacitors connected to switching elements, of the switching elements SWA1 to SWA6, that are on. Meanwhile, the electro-optical panel-side capacitance CP is a capacitance externally connected to the data voltage output terminal TVQ (parasitic capacitance, circuit element capacitance). In the example illustrated in FIG. 3, this is the board capacitance CP1 and the panel capacitance CP2. Meanwhile, the capacitance CO of the capacitor circuit 10 is the total of the capacitances of the capacitors C1 to C10.

The prescribed capacitance ratio relationship refers to a relationship in a ratio between the driving-side capacitance CO and the driven-side capacitance CA+CP. This is not limited to a capacitance ratio in the case where the values of each capacitance are measured (where the capacitance value are explicitly determined). For example, the capacitance ratio may be estimated from the output voltage VQ for prescribed tone data GD [10:1]. The electro-optical panel-side capacitance CP is normally not a measured value obtained in advance, and thus the capacitance CA of the variable capacitance circuit 30 cannot be determined directly. Accordingly, as will be described later with reference to FIG. 8, the capacitance CA of the variable capacitance circuit 30 is determined so that, for example, a VQ of 10 V is outputted for a median value "200h" of the tone data GD [10:1]. In this case, the capacitance ratio is ultimately estimated as being CO:(CA+CP)=1:2, and the capacitance CP can be estimated from this ratio and the capacitance CA (can be estimated, but the capacitance CP need not be known).

In the first configuration example illustrated in FIG. 1 and the like, there is an issue in that a design change is necessary each time the connection environment of the driver 100 (the design of the mounting board, the type of the electro-optical panel 200, or the like) changes.

With respect to this point, according to the second configuration example, a generic driver 100 that does not depend on the connection environment of the driver 100 can be realized by providing the variable capacitance circuit 30. In other words, even in the case where the electro-optical panel-side capacitance CP is different, the prescribed capacitance ratio relationship (for example, CO:(CA+CP)=1:2) can be realized by adjusting the capacitance CA of the variable capacitance circuit 30 in accordance therewith. The data voltage range (7.5 V to 12.5 V in the example illustrated in FIGS. 4A to 4C) is determined by this capacitance ratio relationship, and thus a data voltage range that does not depend on the connection environment can be realized.

Meanwhile, in the capacitive driving carried out by the capacitor circuit 10 and the capacitor driving circuit 20, the pixels are driven by charge redistribution, and thus the data voltages can be written to the pixels at higher speeds than through amplifier driving (that is, the data voltages are settled in a short amount of time). Because higher speeds are possible, an electro-optical panel having a higher number of pixels (that is, a higher resolution) can be driven. In capacitive driving, charges are not supplied freely in the same manner as amplifier driving, but providing the variable capacitance circuit 30 makes it possible to adjust the charges supplied to the pixels. In other words, by providing the variable capacitance circuit 30, higher speeds can be realized through capacitive driving, and desired data voltages can be outputted.

In addition, in this embodiment, the capacitor driving circuit 20 outputs the first voltage level (0 V) or the second voltage level (15 V) as driving voltages corresponding to the respective first to tenth capacitor driving voltages, based on the first to tenth bits GD1 to GD10 of the tone data GD [10:1]. The prescribed capacitance ratio relationship is determined by a voltage relationship between a voltage difference between the first voltage level and the second voltage level (15 V) and the data voltage outputted to the data voltage output terminal TVQ (the output voltage VQ).

In the example illustrated in FIGS. 4A to 4C, the range of data voltages outputted to the data voltage output terminal TVQ is 5 V (7.5 V to 12.5 V), for example. In this case, the prescribed capacitance ratio relationship is determined so that the voltage relationship is realized between the voltage difference between the first voltage level and the second voltage level (15 V) and the data voltage range (5 V). In other words, a capacitance ratio of CO:(CA+CP)=1:2 at which 15 V is divided to 5 V through voltage division by the capacitance CO and the capacitance CA+CP becomes the prescribed capacitance ratio relationship.

By doing so, the prescribed capacitance ratio relationship of CO:(CA+CP)=1:2 can be determined from the voltage relationship between the voltage difference between the first voltage level and the second voltage level (15 V) and the range of data voltages outputted to the data voltage output terminal TVQ (a range of 5 V). Conversely, whether or not the prescribed capacitance ratio relationship is realized can be determined by examining the voltage relationship. In other words, even if the electro-optical panel-side capacitance CP is not known, the capacitance CA of the variable capacitance circuit 30 at which the capacitance ratio of CO:(CA+CP)=1:2 is realized can be determined from the voltage relationship (the flow illustrated in FIG. 8, for example).

Figure 6:
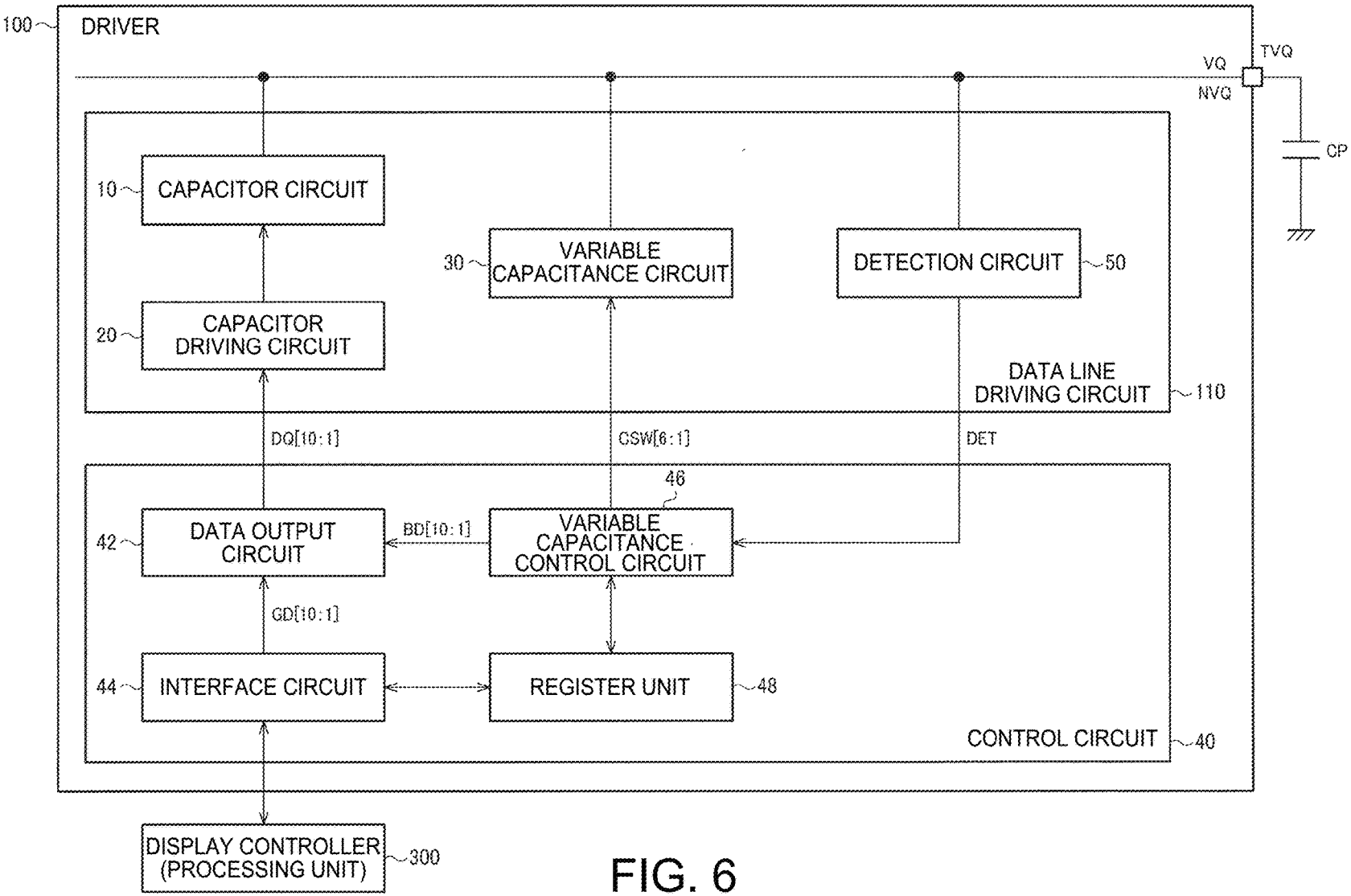
FIG. 6 illustrates an example of the detailed configuration of a driver.

Meanwhile, in this embodiment, the driver 100 may include a detection circuit 50 that detects the voltage VQ at the data voltage output terminal TVQ, as illustrated in FIG. 6, which will be described later. The capacitance CA of the variable capacitance circuit 30 may then be set based on a detection result from the detection circuit 50.

By doing so, the data voltage outputted to the data voltage output terminal TVQ can be detected, and whether or not the stated voltage relationship that achieves the prescribed capacitance ratio relationship is realized can be determined based on that detection result. In other words, by detecting whether or not desired data voltages are outputted relative to prescribed tone data GD [10:1], the capacitance CA of the variable capacitance circuit 30 that realizes the prescribed capacitance ratio relationship CO:(CA+CP)=1:2 can be determined.

In addition, in this embodiment, the variable capacitance circuit 30 includes the first to sixth adjusting capacitors CA1 to CA6, and the first to sixth switching elements SWA1 to SWA6 that are provided between the first to sixth adjusting capacitors CA1 to CA6 and the data voltage output terminal TVQ.

By doing so, connects and disconnects between the first to sixth adjusting capacitors CA1 to CA6 and the data voltage output terminal TVQ can be controlled by controlling whether the first to sixth switching elements SWA1 to SWA6 are on or off, and the capacitance CA of the variable capacitance circuit 30 can be adjusted as a result. Note, however, that the variable capacitance circuit 30 is not limited to this configuration, and may be any circuit (or element) whose capacitance value can be adjusted in a variable manner.

In addition, in this embodiment, in a reset period before the capacitive driving that drives the electro-optical panel 200 using the capacitor driving circuit 20 and the capacitor circuit 10 (for example, in FIG. 4A), the data voltage output terminal TVQ is set to the prescribed reset voltage VC of 7.5 V, in a state in which the first to tenth capacitor driving voltages (first voltage level; 0 V) corresponding to initial value data of the capacitor driving circuit 20 (GD[10:1]="000h") are outputted.

By doing so, and setting the reset voltage VC to 7.5 V for the initial value data, a charge corresponding to that reset voltage VC of 7.5 V is accumulated in the data voltage output node NVQ (in other words, the capacitances CO, CA, and CP). Through this, the initial value data and the reset voltage VC of 7.5 V are associated, and thereafter, the reset voltage VC of 7.5 V will be outputted for the initial value data as long as the charge at the data voltage output node NVQ is conserved. In the case where the tone data GD [10:1] differs from the initial value data, charge redistribution is carried out in correspondence therewith, and a different data voltage than the reset voltage VC of 7.5 V is outputted. In other words, data voltage that takes the reset voltage VC of 7.5 V as a reference is outputted. The charge at the data voltage output node NVQ is conserved in the charge redistribution as well, and thus the same data voltage can always be outputted for the same tone data GD [10:1].

For example, in the example illustrated in FIGS. 5A and 5B, the initial value data is "000h", and for the tone data GD [10:1] of "000h" to "3FF", data voltages of 7.5 V to 12.5 V are outputted with the reset voltage VC of 7.5 V as a reference.

Meanwhile, in this embodiment, the driver 100 may include a reset voltage terminal TVC for setting the prescribed reset voltage VC of 7.5 V, as will be described later with reference to FIG. 10.

Note that the method for supplying the reset voltage VC of 7.5 V is not limited to the reset voltage terminal TVC. For example, the driver 100 may include a reset voltage amplifier circuit for setting the prescribed reset voltage VC of 7.5 V.

Although capacitive driving basically assumes that no charge is supplied from the exterior in order to conserve the charge at the data voltage output node NVQ, when carrying out a reset, it is necessary to supply a charge from the exterior to carry out the reset. With respect to this point, according to this embodiment, a charge can be supplied to the data voltage output node NVQ from the reset voltage terminal TVC or the reset voltage amplifier circuit, and thus the charge (voltage) at the data voltage output node NVQ can be reset.

In addition, according to this embodiment, reset operations in the reset period are carried out in the case where the data lines of the electro-optical panel 200 are driven by driving aside from capacitive driving.

In the case where the data lines of the electro-optical panel 200 (in other words, the data voltage output node NVQ) are driven by driving aside from capacitive driving, a charge is supplied to the data voltage output node NVQ by that driving and the charge conservation at the data voltage output node NVQ breaks down. In other words, the initial value data and the reset voltage VC of 7.5 V no longer correspond to each other. Accordingly, in the case where the data lines of the electro-optical panel 200 are driven by driving aside from capacitive driving, the correspondence between the initial value data and the reset voltage VC of 7.5 V is restored by carrying out the reset operations, and the correct data voltage that takes the reset voltage VC of 7.5 V as a reference can be outputted.

Specifically, driving aside from capacitive driving is precharge driving that outputs a prescribed precharge voltage VPR to the data lines, as will be described later with reference to FIGS. 10, 11, and so on.

The driver 100 includes a precharge amplifier circuit AMPR that carries out precharge driving, and a precharge terminal TPR to which an output of the precharge amplifier circuit AMPR is connected and that is for connecting an external capacitor CPR.

In this manner, the data voltage output node NVQ is driven by the precharge voltage VPR, which is different from the reset voltage VC of 7.5 V, in the precharging. As such, although the charge conservation will break down as described above, carrying out a reset after the precharge makes it possible to always start the output of the data voltage from the same charge accumulation state (in other words, always using the same voltage VC as a reference).

In addition, in this embodiment, charge redistribution is carried out among the first to tenth capacitors C1 to C10, the capacitance CA of the variable capacitance circuit 30, and the electro-optical panel-side capacitance CP as a result of the capacitor driving circuit 20 outputting the first to tenth capacitor driving voltages, and a data voltage corresponding to the tone data GD [10:1] is outputted to the data voltage output terminal TVQ.

In other words, as described with reference to FIGS. 5A and 5B, the charge redistribution occurs by changing the first to tenth capacitor driving voltages in a state where the data voltage output node NVQ conserves a charge. The voltage VQ at the data voltage output node NVQ is determined as a result of this charge redistribution. The voltage VQ is determined in correspondence with the tone data GD [10:1], as indicated by Formula FE, and the voltage VQ becomes a data voltage corresponding to the tone data GD [10:1].

In addition, in this embodiment, the driver 100 includes first to eighth data line driving circuits DD1 to DD8 and first to eighth data voltage output terminals connected to outputs of the first to eighth data line driving circuits DD1 to DD8, as will be described later with reference to FIG. 12. Each data line driving circuit in the first to eighth data line driving circuits DD1 to DD8 includes the capacitor driving circuit 20, the capacitor circuit 10, and the variable capacitance circuit 30.

The electro-optical panel 200 includes first to eighth data lines DL1 to DL8 connected to the first to eighth data voltage output terminals, ((j−1)×k+1)th to (j×k)th source lines SL((j−1)×k+1) to SL (j×k) (where k=8 and j is a natural number no greater than s, which is 160), and ((j−1)×k+1)th to (j×k)th switching elements SWEP((j−1)×k+1) to SWEP (j×k) provided between the first to eighth data lines DL1 to DL8 and the ((j−1)×k+1)th to (j×k)th source lines SL((j−1)×k+1) to SL (j×k).

As will be described later with reference to FIG. 13, after first to eighth switching elements SWEP1 to SWEP8 (j=1) have turned on and the first to eighth data line driving circuits DD1 to DD8 have driven first to eighth source lines SL1 to SL8, ninth to 16th switching elements SWEP9 to SWEP16 (j=2) turn on and the first to eighth data line driving circuits DD1 to DD8 drive ninth to 16th source lines SL9 to SL16.

By doing so, the electro-optical panel 200 can be driven through phase expansion driving. Phase expansion driving can drive many source lines with few data line driving circuits, and thus the driver 100 can be reduced in size. On the other hand, the number of instances of driving for displaying a single frame of an image increases, and thus high-speed driving (high-speed data voltage settling) is necessary. With respect to this point, according to this embodiment, the capacitive driving enables high-speed driving, and thus electro-optical panels having greater numbers of pixels can be driven than in the case of amplifier driving.

5. Detailed Example of Configuration of Driver

FIG. 6 illustrates a detailed example of the configuration of the driver according to this embodiment. This driver 100 includes a data line driving circuit 110 and a control circuit 40. The data line driving circuit 110 includes the capacitor circuit 10, the capacitor driving circuit 20, the variable capacitance circuit 30, and the detection circuit 50. The control circuit 40 includes a data output circuit 42, an interface circuit 44, a variable capacitance control circuit 46, and a register unit 48. Note that constituent elements that are the same as constituent elements already described are assigned the same reference numerals, and descriptions of those constituent elements are omitted as appropriate.

A single data line driving circuit 110 is provided corresponding to a single data voltage output terminal TVQ. Although the driver 100 includes a plurality of data line driving circuits and a plurality of data voltage output terminals, only one is illustrated in FIG. 6.

The interface circuit 44 carries out an interfacing process between a display controller 300 (broadly defined as a processing unit) that controls the driver 100 and the driver 100. For example, the interfacing process is carried out through serial communication such as LVDS (Low Voltage Differential Signaling) or the like. In this case, the interface circuit 44 includes an I/O circuit that inputs/outputs serial signals and a serial/parallel conversion circuit that carries out serial/parallel conversion on control data, image data, and so on. Meanwhile, a line latch that latches the image data inputted from the display controller 300 and converted into parallel data is also included. The line latch latches image data corresponding to a single horizontal scanning line at one time, for example.

The data output circuit 42 extracts the tone data GD [10:1] to be outputted to the capacitor driving circuit 20 from the image data corresponding to the horizontal scanning line, and outputs this data as data DQ[10:1]. The data output circuit 42 includes, for example, a timing controller that controls a driving timing of the electro-optical panel 200, a selection circuit that selects the tone data GD [10:1] from the image data corresponding to the horizontal scanning line, and an output latch that latches the selected tone data GD [10:1]. As will be described later with reference to FIG. 12 and so on, in the case of phase expansion driving, the output latch latches eight pixels' worth of the tone data GD [10:1] (equivalent to the number of the data lines DL1 to DL8) at one time. In this case, the timing controller controls the operational timing of the selection circuit, the output latch, and so on in accordance with the driving timing of the phase expansion driving. Meanwhile, a horizontal synchronization signal, a vertical synchronization signal, and so on may be generated based on the image data received by the interface circuit 44. Furthermore, a signal (ENBX) for controlling the switching elements (SWEP1 and the like) in the electro-optical panel 200 on and off, a signal for controlling gate driving (selection of horizontal scanning lines in the electro-optical panel 200), and so on may be outputted to the electro-optical panel 200.

The detection circuit 50 detects the voltage VQ at the data voltage output node NVQ. Specifically, the detection circuit 50 compares a prescribed detection voltage with the voltage VQ and outputs a result thereof as a detection signal DET. For example, DET="1" is outputted in the case where the voltage VQ is greater than or equal to the detection voltage, and DET="0" is outputted in the case where the voltage VQ is less than the detection voltage.

The variable capacitance control circuit 46 sets the capacitance of the variable capacitance circuit 30 based on the detection signal DET. The flow of this setting process will be described later with reference to FIG. 8. The variable capacitance control circuit 46 outputs a setting value CSW [6:1] as a control signal for the variable capacitance circuit 30. This setting value CSW[6:1] is constituted of first to sixth bits CSW1 to CSW6 (first to mth bits). A bit CSWs (where s is a natural number no greater than m, which is 6) is inputted into the switching element SWAs of the variable capacitance circuit 30. For example, in the case where the bit CSWs="0", the switching element SWAs turns off, whereas in the case where the bit CSWs="1", the switching element SWAs turns on. In the case where the setting process is carried out, the variable capacitance control circuit 46 outputs detection data BD[10:1]. Then, the data output circuit 42 outputs the detection data BD[10:1] to the capacitor driving circuit 20 as the output data DQ[10:1].

The register unit 48 stores the setting value CSW[6:1] of the variable capacitance circuit 30 set through the setting process. The register unit 48 is configured to be accessible from the display controller 300 via the interface circuit 44. In other words, the display controller 300 can read out the setting value CSW[6:1] from the register unit 48. Alternatively, the configuration may be such that the display controller 300 can write the setting value CSW[6:1] into the register unit 48.

Figure 7:
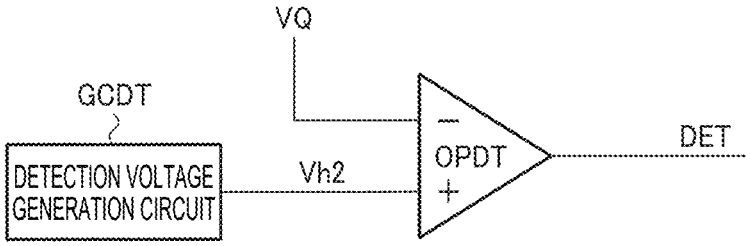
FIG. 7 illustrates an example of the detailed configuration of a detection circuit.

FIG. 7 illustrates an example of the detailed configuration of the detection circuit 50. The detection circuit 50 includes a detection voltage generation circuit GCDT that generates a detection voltage Vh2 and a comparator OPDT that compares the voltage VQ at the data voltage output node NVQ with the detection voltage Vh2.

The detection voltage generation circuit GCDT outputs the detection voltage Vh2, which is determined in advance by a voltage division circuit or the like using a resistance element, for example. Alternatively, a variable detection voltage Vh2 may be outputted through register settings or the like. In this case, the detection voltage generation circuit GCDT may be a D/A conversion circuit that D/A-converts a register setting value.

6. Process for Setting Capacitance of Variable Capacitance Circuit

Figure 8:
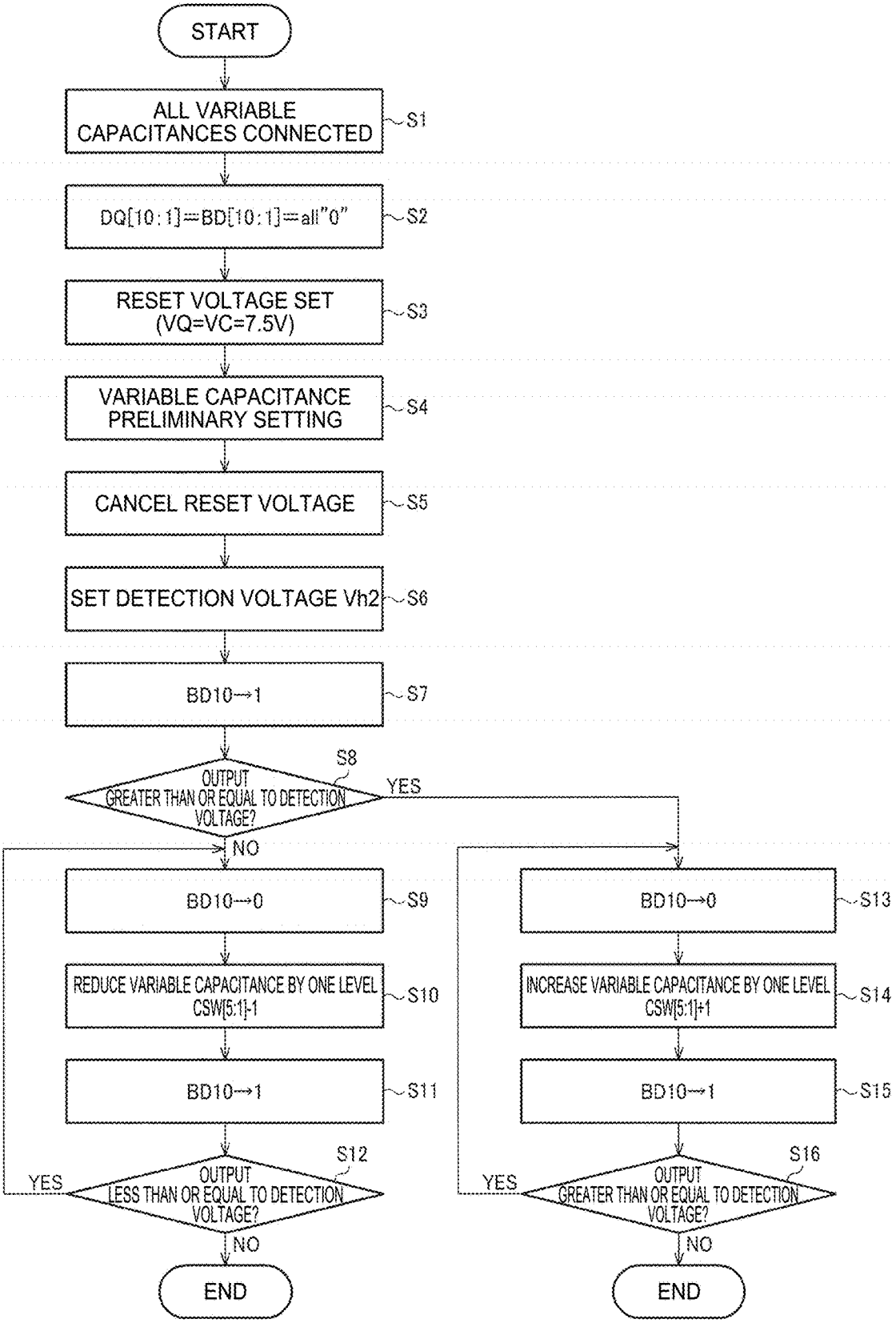
FIG. 8 is a flowchart illustrating a process for setting a capacitance of a variable capacitance circuit.

FIG. 8 is a flowchart illustrating a process for setting the capacitance of the variable capacitance circuit 30. This process is carried out, for example, during startup (an initialization process) when the power of the driver 100 is turned on.

As illustrated in FIG. 8, when the process starts, the setting value CSW[6:1] of "3Fh" is outputted, and all of the switching elements SWA1 to SWA6 of the variable capacitance circuit 30 are turned on (step S1). Next, the detection data BD[10:1] of "000h" is outputted, and the outputs of all of the driving units DR1 to DR10 of the capacitor driving circuit 20 are set to 0 V (step S2). Next, the output voltage VQ is set to the reset voltage VC of 7. 5 V (step S3). This reset voltage VC is supplied, for example, from the exterior via the terminal TVC, which will be described later with reference to FIG. 10.

Next, the capacitance of the variable capacitance circuit 30 is preliminarily set (step S4). For example, the setting value CSW[6:1] is set to "1Fh". In this case, the switching element SWA6 turns off and the switching elements SWA5 to SWA1 turn on, and thus the capacitance is half the maximum value. Next, the supply of the reset voltage VC to the output voltage VQ is canceled (step S5). Then, the detection voltage Vh2 is set to a desired voltage (step S6). For example, the detection voltage Vh2 is set to 10 V.

Next, the MSB of the detection data BD[10:1] is changed from BD10="0" to BD10="1" (step S7). Then, it is detected whether or not the output voltage VQ is greater than or equal to the detection voltage Vh2 of 10 V (step S8).

In the case where the output voltage VQ is less than the detection voltage Vh2 of 10 V in step S8, the bit BD10 is returned to "0" (step S9). Next, 1 is subtracted from the setting value CSW[6:1] of "1Fh" for "1Eh" and the capacitance of the variable capacitance circuit 30 is lowered by one level (step S10). Next, the bit BD10 is set to "1" (step S11). Then, it is detected whether or not the output voltage VQ is less than or equal to the detection voltage Vh2 of 10 V (step S12). The process returns to step S9 in the case where the output voltage VQ is less than or equal to the detection voltage Vh2 of 10 V, and the process ends in the case where the output voltage VQ is greater than the detection voltage Vh2 of 10 V.

In the case where the output voltage VQ is greater than or equal to the detection voltage Vh2 of 10 V in step S8, the bit BD10 is returned to "0" (step S13). Next, 1 is added to the setting value CSW[6:1] of "1Fh" for "20h" and the capacitance of the variable capacitance circuit 30 is raised by one level (step S14). Next, the bit BD10 is set to "1" (step S15). Then, it is detected whether or not the output voltage VQ is greater than or equal to the detection voltage Vh2 of 10 V (step S16). The process returns to step S13 in the case where the output voltage VQ is greater than or equal to the detection voltage Vh2 of 10 V, and the process ends in the case where the output voltage VQ is less than the detection voltage Vh2 of 10 V.

FIGS. 9A and 9B schematically illustrate the setting value CSW[6:1] being determined through the stated steps S8 to S16.

In the aforementioned flow, the MSB of the detection data BD[10:1] is set to BD10="1", and the output voltage VQ at that time is compared to the detection voltage Vh2 of 10 V. BD[10:1]="200h" is a median value of the tone data range "000h" to "3FFh", and the detection voltage Vh2 of 10 V is a median value of the data voltage range of 7.5 V to 12.5 V. In other words, if the output voltage VQ matches the detection voltage Vh2 of 10 V when BD10="1", the correct (desired) data voltage is obtained.

As illustrated in FIG. 9A, in the case of "NO" in step S8 for the preliminary setting value CSW[6:1]="1Fh", VQ<Vh2. In this case, it is necessary to raise the output voltage VQ. From Formula FD in FIG. 4B, it can be seen that the output voltage VQ will rise if the capacitance CA of the variable capacitance circuit 30 is reduced, and thus the setting value CSW[6:1] is reduced by "1" at a time. The setting value CSW[6:1] stops at "1Ah", where VQ≥Vh2 for the first time. Through this, the setting value CSW[6:1] at which the output voltage VQ nearest to the detection voltage Vh2 is obtained can be determined.

As illustrated in FIG. 9B, in the case of "YES" in step S8 for the preliminary setting value CSW[6:1]="1Fh", VQ≥Vh2. In this case, it is necessary to lower the output voltage VQ. From Formula FD in FIG. 4B, it can be seen that the output voltage VQ will drop if the capacitance CA of the variable capacitance circuit 30 is increased, and thus the setting value CSW[6:1] is increased by "1" at a time. The setting value CSW[6:1] stops at "24h", where VQ<Vh2 for the first time. Through this, the setting value CSW[6:1] at which the output voltage VQ nearest to the detection voltage Vh2 is obtained can be determined.

The setting value CSW[6:1] obtained through the above processing is determined as the final setting value CSW[6:1], and that setting value CSW[6:1] is written into the register unit 48. When driving the electro-optical panel 200 through capacitive driving, the capacitance of the variable capacitance circuit 30 is set using the setting value CSW[6:1] stored in the register unit 48.

Although this embodiment describes an example in which the setting value CSW[6:1] of the variable capacitance circuit 30 is stored in the register unit 48, the invention is not limited thereto. For example, the setting value CSW[6:1] may be stored in a memory such as a RAM or the like, or the setting value CSW[6:1] may be set using a fuse (for example, setting the setting value through cutting by a laser or the like during manufacture).

7. Second Detailed Example of Configuration of Driver

Figure 10:
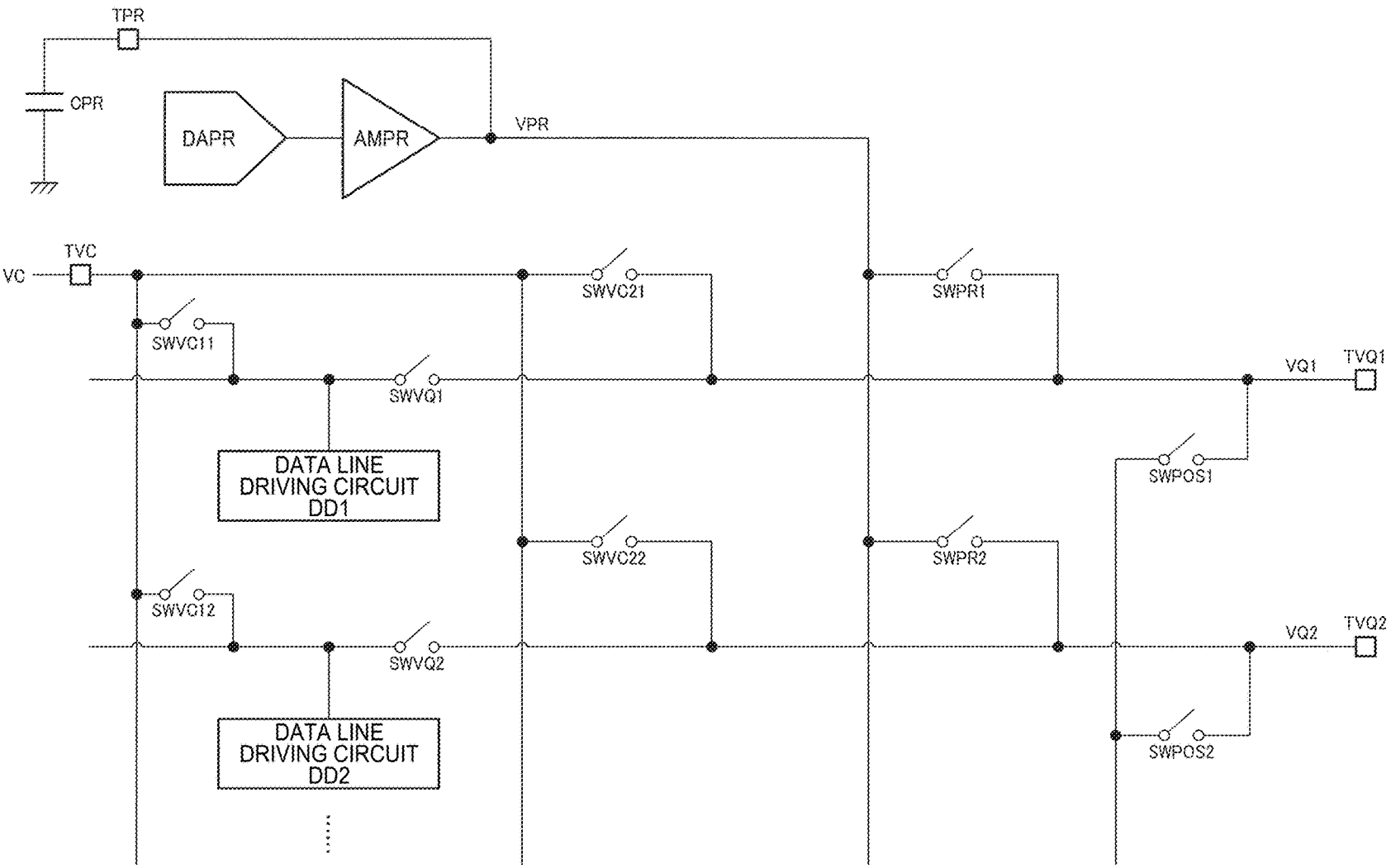
FIG. 10 illustrates a second example of the detailed configuration of a driver.

FIG. 10 illustrates a second example of the detailed configuration of the driver 100 according to this embodiment. This driver 100 includes the precharge terminal TPR, the reset voltage terminal TVC (common voltage terminal), data voltage output terminals TVQ1 and TVQ2, a precharge D/A conversion circuit DAPR, the precharge amplifier circuit AMPR, data line driving circuits DD1 and DD2, precharge switching elements SWPR1 and SWPR2, reset switching elements SWVC11, SWVC12, SWVC21, and SWVC22, output switching elements SWVQ1 and SWVQ2, and postcharge switching elements SWPOS1 and SWPOS2.

The data line driving circuits DD1 and DD2 each correspond to the data line driving circuit 110 illustrated in FIG. 6. Although only two are illustrated in FIG. 10, in reality, the driver 100 has the same number (or more) of data line driving circuits as there are data lines in the electro-optical panel 200. Likewise, the numbers of data voltage output terminals, various types of switching elements, and so on are the same as the number of data line driving circuits.

The reset voltage VC (common voltage) is supplied to the reset voltage terminal TVC from an external power source circuit or the like, for example.

Note that the method for supplying the reset voltage VC is not limited to the reset voltage terminal TVC. For example, the driver 100 may include a reset voltage amplifier circuit that outputs the reset voltage VC.

The precharge terminal TPR is connected to an output of the precharge amplifier circuit AMPR. The precharge D/A conversion circuit DAPR D/A-converts a precharge setting value (a register value, for example) and generates the precharge voltage VPR, and the precharge amplifier circuit AMPR drives the precharge terminal TPR using the precharge voltage VPR. The precharge voltage VPR is a voltage that is lower than the reset voltage VC, for example (within a data voltage range of 7.5 V to 2.5 V in negative-polarity driving).

The external precharge capacitor CPR is connected to the precharge terminal TPR. The precharge capacitor CPR accumulates a charge corresponding to the precharge voltage VPR, and supplies the charge to the data line during a precharge. The precharge voltage VPR can be smoothed by providing the precharge capacitor CPR, and thus the charge supply performance of the precharge amplifier circuit AMPR can be reduced. In other words, although the precharge capacitor CPR emits a charge when the precharge is carried out, it is sufficient that the precharge amplifier circuit AMPR can replenish the charge in the precharge capacitor CPR before the next precharge is carried out.

Figure 11:
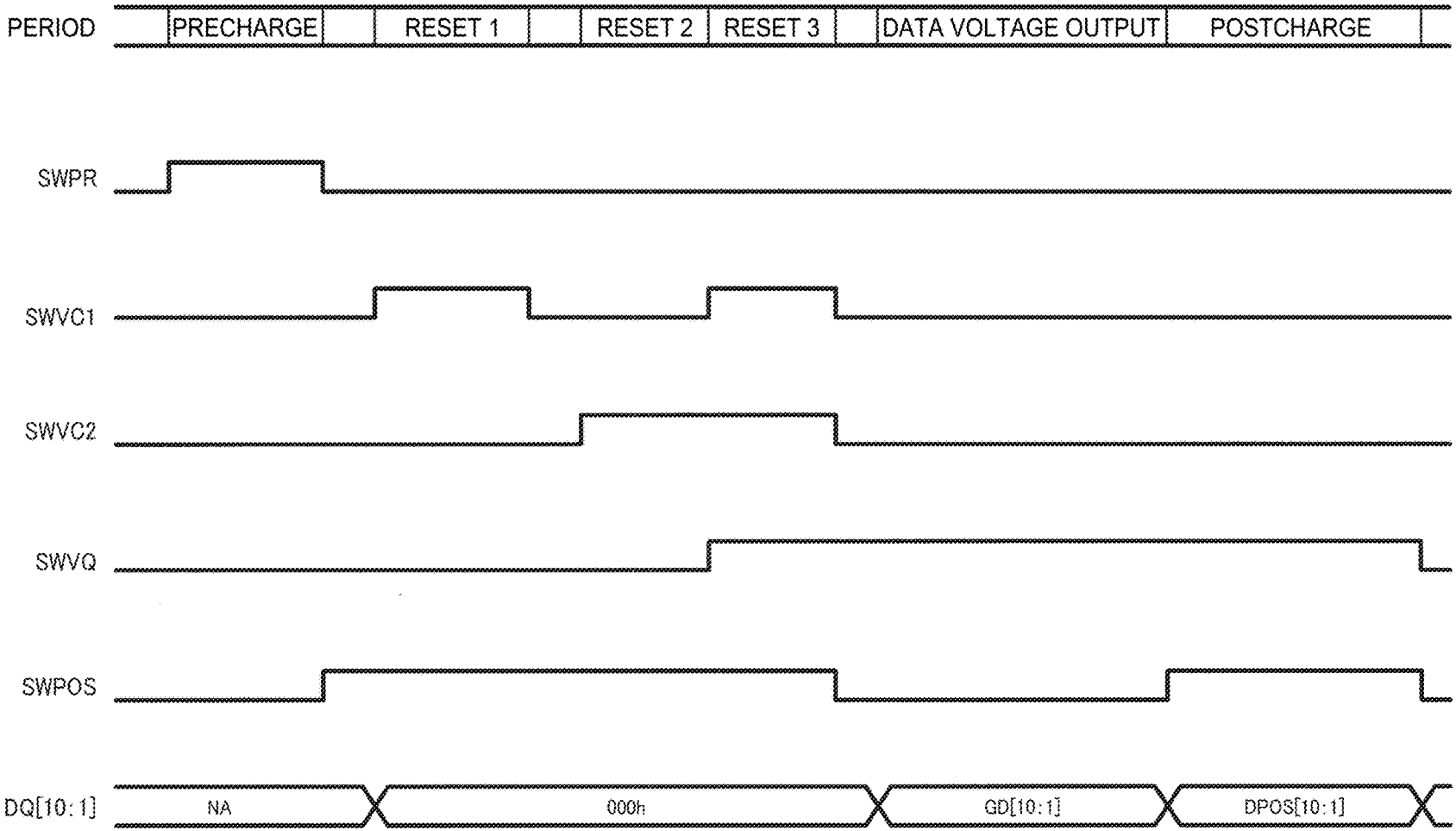
FIG. 11 is an operational timing chart of the second detailed configuration example.

FIG. 11 is an operational timing chart of the second detailed example of the configuration of the driver 100. In FIG. 11, numbers at the ends of the reference numerals of the switching element have been omitted. For example, "SWPR" indicates the precharge switching elements SWPR1 and SWPR2. In the timing chart for the switching elements, high-level indicates a state in which a switching element is on, and low-level indicates a state in which the switching element is off.

As illustrated in FIG. 11, the driving of the electro-optical panel 200 is carried out in the order of precharge, reset, data voltage output, and postcharge. This series of operations is carried out in a single horizontal scanning period, for example.

In a precharge period, the precharge switching elements SWPR1 and SWPR2 turn on, and the precharge voltage VPR is outputted from the data voltage output terminals TVQ1 and TVQ2.

A reset period is divided into first to third reset periods. In the first to third reset periods, DQ[10:1] is set to "000h", and the driving units DR1 to DR10 of the capacitor driving circuit 20 all output 0 V.

In the first reset period, the reset switching elements SWVC11 and SWVC12 turn on, and the outputs of the data line driving circuits DD1 and DD2 (one end of the capacitors C1 to C10) are set to the reset voltage VC. Through this, the charges in the capacitor circuit 10 and the variable capacitance circuit 30 are reset. Meanwhile, the postcharge switching elements SWPOS1 and SWPOS2 turn on, and the data voltage output terminals TVQ1 and TVQ2 are connected in common.

In the second reset period, the reset switching elements SWVC21 and SWVC22 and the postcharge switching elements SWPOS1 and SWPOS2 turn on, and the reset voltage VC is outputted from the data voltage output terminals TVQ1 and TVQ2. Through this, the charge in the electro-optical panel-side capacitance CP is reset.

In the third reset period, the output switching elements SWVQ1 and SWVQ2 turn on, the output of the data line driving circuit DD1 and the data voltage output terminal TVQ1 are connected, and the output of the data line driving circuit DD2 and the data voltage output terminal TVQ2 are connected. In addition, the reset switching elements SWVC11, SWVC12, SWVC21, and SWVC22 and the postcharge switching elements SWPOS1 and SWPOS2 turn on, and the reset voltage VC is outputted from the data voltage output terminals TVQ1 and TVQ2.

In a data voltage output period, DQ[10:1] is set to GD[10:1]. Then, the output switching elements SWVQ1 and SWVQ2 turn on, and data voltages corresponding to the tone data GD [10:1] are outputted from the data voltage output terminals TVQ1 and TVQ2.

In a postcharge period, DQ[10:1] is set to DPOS[10:1]. DPOS[10:1] is postcharge data. The output switching elements SWVQ1 and SWVQ2 and the postcharge switching elements SWPOS1 and SWPOS2 turn on, and data voltages corresponding to the postcharge data DPOS[10:1] are outputted from the data voltage output terminals TVQ1 and TVQ2.

8. Phase Expansion Driving Method

Next, a method of driving the electro-optical panel 200 will be described. The following describes an example of phase expansion driving, but the method of driving carried out by the driver 100 in this embodiment is not limited to phase expansion driving.

Figure 12:
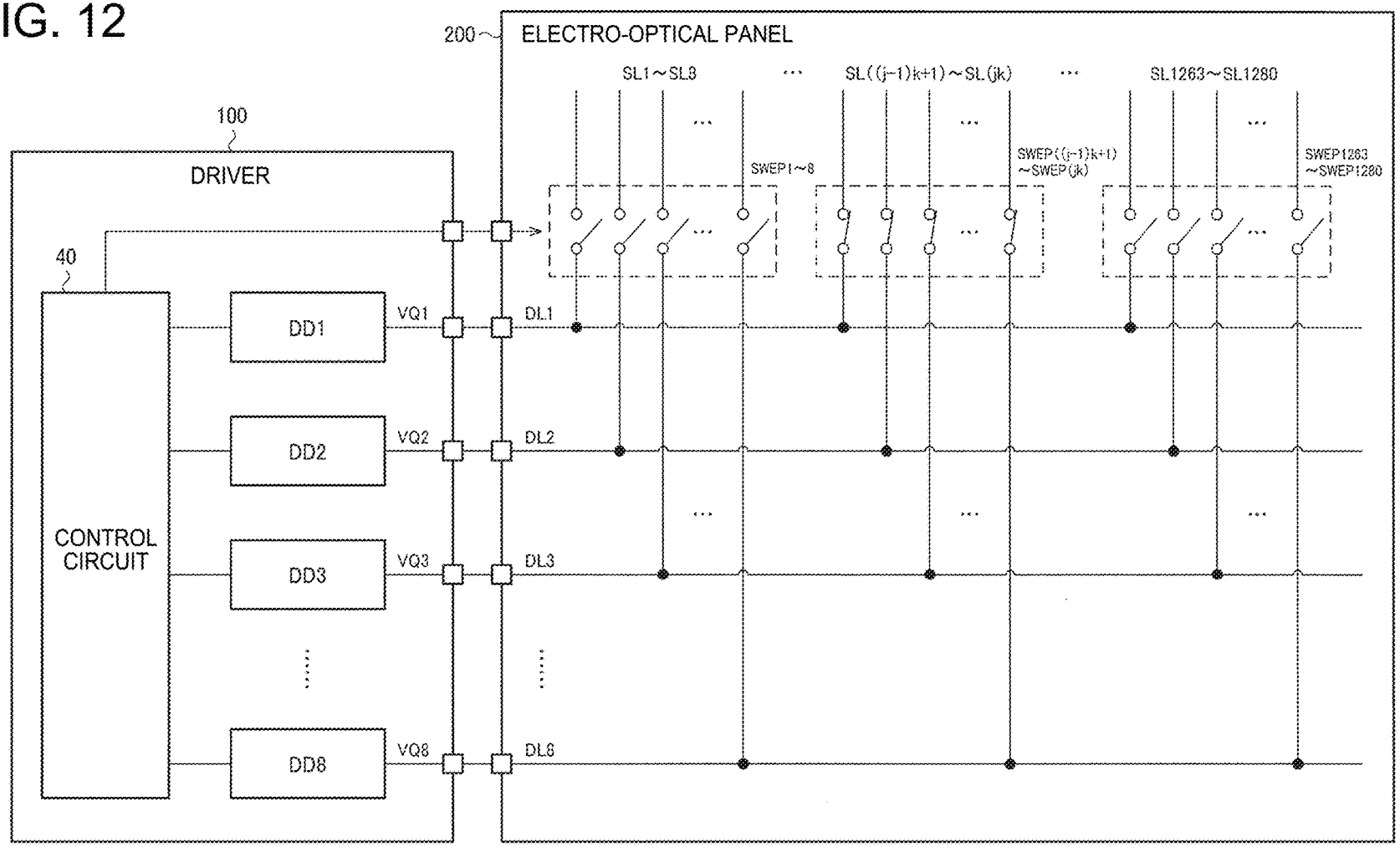
FIG. 12 illustrates a third example of the detailed configuration of a driver, an example of the detailed configuration of an electro-optical panel, and an example of the configuration of connections between the driver and the electro-optical panel.

FIG. 12 illustrates a third example of the detailed configuration of a driver, an example of the detailed configuration of an electro-optical panel, and an example of the configuration of connections between the driver and the electro-optical panel.

The driver 100 includes the control circuit 40 and first to kth data line driving circuits DD1 to DDk (where k is a natural number of 2 or more). The data line driving circuits DD1 to DDk each correspond to the data line driving circuit 110 illustrated in FIG. 6. Note that the following will describe an example in which k=8.

The control circuit 40 outputs corresponding tone data to each data line driving circuit in the data line driving circuits DD1 to DD8. The control circuit 40 also outputs a control signal (for example, ENBX illustrated in FIG. 13 or the like) to the electro-optical panel 200.

The data line driving circuits DD1 to DD8 convert the tone data into data voltages, and output those data voltages to the data lines DL1 to DL8 of the electro-optical panel 200 as output voltages VQ1 to VQ8.

The electro-optical panel 200 includes the data lines DL1 to DL8 (first to kth data lines), switching elements SWEP1 to SWEP(tk), and source lines SL1 to SL(tk). t is a natural number of 2 or more, and the following will describe an example in which t=160 (in other words, tk=160×8=1,280 (WXGA)).

Of the switching elements SWEP1 to SWEP1280, one end of each of the switching elements SWEP((j−1)×k+1) to SWEP(j×k) is connected to the data lines DL1 to DL8. j is a natural number no greater than t, which is 160. For example, in the case where j=1, the switching elements are SWEP1 to SWEP8.

The switching elements SWEP1 to SWEP1280 are constituted of TFTs (Thin Film Transistors) or the like, for example, and are controlled based on control signals from the driver 100. For example, the electro-optical panel 200 includes a switching control circuit (not shown), and that switching control circuit controls the switching elements SWEP1 to SWEP1280 to turn on and off based on a control signal such as ENBX.

Figure 13:
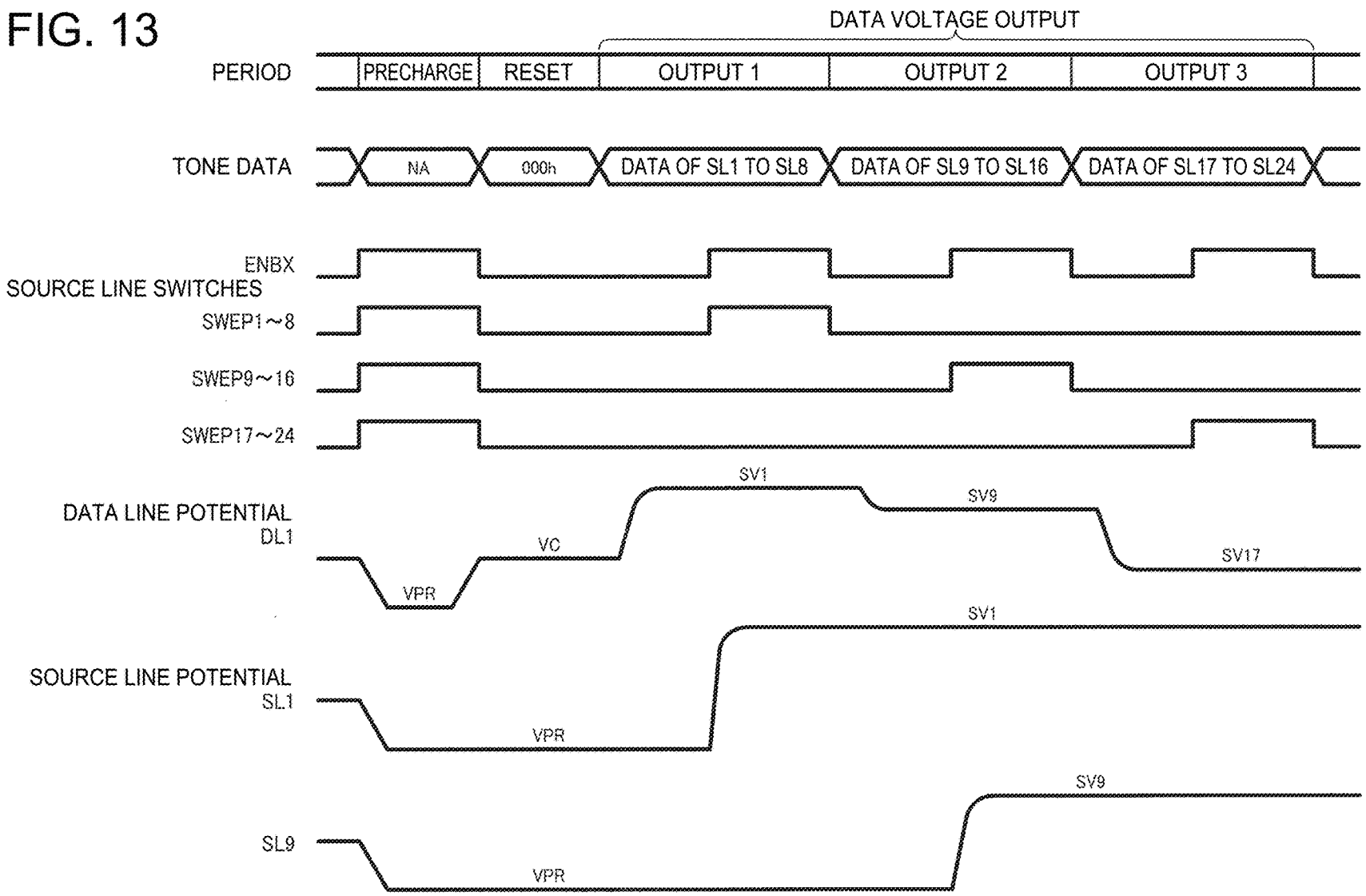
FIG. 13 is an operational timing chart of a driver and an electro-optical panel.

FIG. 13 is an operational timing chart of the driver 100 and the electro-optical panel 200 illustrated in FIG. 12.

In the precharge period, the signal ENBX goes to high-level, and all of the switching elements SWEP1 to SWEP1280 turn on. Then, all of the source lines SL1 to SL1280 are set to the precharge voltage VPR.

In the reset period, the signal ENBX goes to low-level, and the switching elements SWEP1 to SWEP1280 all turn off. The data lines DL1 to DL8 are then set to the reset voltage VC of 7.5 V. The source lines SL1 to SL1280 remain at the precharge voltage VPR.

In a first output period in the data voltage output period, the tone data corresponding to the source lines SL1 to SL8 are inputted into the data line driving circuits DD1 to DD8. Then, capacitive driving is carried out by the capacitor circuit 10 and the capacitor driving circuit 20, and the data lines DL1 to DL8 are driven by data voltages SV1 to SV8. After the capacitive driving starts, the signal ENBX goes to high-level, and the switching elements SWEP1 to SWEP8 turn on. Then, the source lines SL1 to SL8 are driven by the data voltages SV1 to SV8. At this time, a single gate line (horizontal scanning line) is selected by a gate driver (not shown), and the data voltages SV1 to SV8 are written into the pixel circuits connected to the selected gate line and the data lines DL1 to DL8. Note that FIG. 13 illustrates potentials of the data line DL1 and the source line SL1 as examples.

In a second output period, the tone data corresponding to the source lines SL9 to SL16 are inputted into the data line driving circuits DD1 to DD8. Then, capacitive driving is carried out by the capacitor circuit 10 and the capacitor driving circuit 20, and the data lines DL1 to DL8 are driven by data voltages SV9 to SV16. After the capacitive driving starts, the signal ENBX goes to high-level, and the switching elements SWEP9 to SWEP16 turn on. Then, the source lines SL9 to SL16 are driven by the data voltages SV9 to SV16. At this time, the data voltages SV9 to SV16 are written into the pixel circuits connected to the selected gate line and the data lines DL9 to DL16. Note that FIG. 13 illustrates potentials of the data line DL1 and the source line SL9 as examples.

Thereafter, the source lines SL17 to SL24, SL25 to SL32, . . . , and SL1263 to SL1280 are driven in the same manner in a third output period, a fourth output period, . . . , and a 160th output period, after which the process moves to the postcharge period.

9. Cross-Sectional Structure of MIM Capacitor

Next, an example of the configuration of a MIM capacitor that enables a high-capacity capacitor to be provided as the capacitor circuit 10, the variable capacitance circuit 30, or the like will be described.

FIG. 14 is a cross-sectional view of a semiconductor substrate (a silicon substrate) of the driver 100. Note that in the following descriptions, "above" refers to a direction perpendicular to the substrate surface and moves away from the substrate toward a side on which a circuit is formed.

An impurity layer such as a diffusion layer is formed on a substrate SUB. The impurity layer forms a source, a drain, and the like of a CMOS transistor, for example.

An insulation later (an $SiO_2$ layer) is formed on the substrate SUB, and a polysilicon layer PLY is formed on the insulation layer. The polysilicon layer PLY forms a gate of a CMOS transistor, a resistance element (a polysilicon resistance), or the like, for example.

An insulation layer is formed on the substrate SUB and the polysilicon layer PLY, and a first metal layer MT1 (a first aluminum layer, for example) is formed thereon. The first metal layer MT1 and the substrate SUB, the first metal layer MT1 and the polysilicon layer PLY, and so on are interconnected by contacts CNT (tungsten plugs, for example).

An insulation layer is formed on the first metal layer MT1, and a second metal layer MT2 (a second aluminum layer, for example) is formed thereon. The second metal layer MT2 and the first metal layer MT1 are interconnected by a first via VI1 (a tungsten plug, for example).

A first MIM dielectric layer IN1 is formed on the second metal layer MT2, and a first MIM metal layer MM1 is formed thereon. A first MIM capacitor is formed by the metal layer MM1, the dielectric layer IN1, and the second metal layer MT2.

An insulation layer is formed on the second metal layer MT2 and the first MIM metal layer MM1, and a third metal layer MT3 (a third aluminum layer, for example) is formed thereon. The third metal layer MT3 and the second metal layer MT2 are interconnected by a second via VI2 (a tungsten plug, for example).

A second MIM dielectric layer IN2 is formed on the third metal layer MT3, and a second MIM metal layer MM2 is formed thereon. A second MIM capacitor is formed by the metal layer MM2, the dielectric layer IN2, and the third metal layer MT3.

An insulation layer is formed on the third metal layer MT3 and the second MIM metal layer MM2, and a fourth metal layer MT4 (a fourth aluminum layer, for example) is formed thereon. The fourth metal layer MT4 and the third metal layer MT3 are interconnected by a third via VI3 (a tungsten plug, for example).

A third MIM dielectric layer IN3 is formed on the fourth metal layer MT4, and a third MIM metal layer MM3 is formed thereon. A third MIM capacitor is formed by the metal layer MM3, the dielectric layer IN3, and the fourth metal layer MT4.

An insulation layer is formed on the fourth metal layer MT4 and the third MIM metal layer MM3, and a fifth metal layer MT5 (a fifth aluminum layer, for example) is formed thereon. The fifth metal layer MT5 and the fourth metal layer MT4 are interconnected by a fourth via VI4 (a tungsten plug, for example). A passivation layer PAS (an insulation layer) is formed on the fifth metal layer MT5.

The stated first to third MIM capacitors can be disposed so as to overlap each other when the substrate is viewed in plan view (that is, so as to match, or so as to partially overlap). If these MIM capacitors stacked in three layers vertically are then connected in parallel, three times the capacitance of a single-layer MIM capacitor can be realized in the same amount of surface area.

10. Electronic Device

Figure 15:
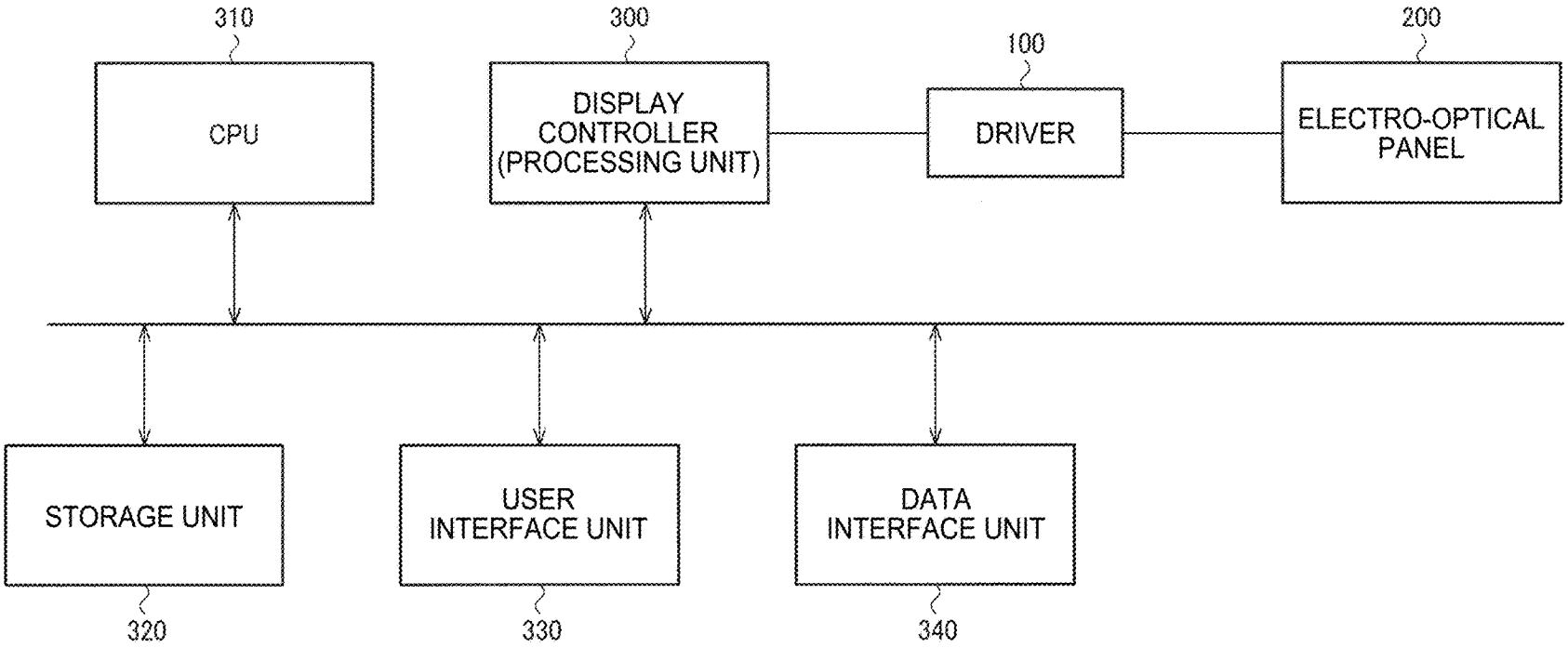
FIG. 15 illustrates an example of the configuration of an electronic device.

FIG. 15 illustrates an example of the configuration of an electronic device in which the driver 100 according to this embodiment can be applied. A variety of electronic devices provided with display devices can be considered as the electronic device according to this embodiment, including projector, a television device, an information processing apparatus (a computer), a mobile information terminal, a car navigation system, a mobile gaming terminal, and so on, for example.

The electronic device illustrated in FIG. 15 includes the driver 100, the electro-optical panel 200, the display controller 300 (a first processing unit), a CPU 310 (a second processing unit), a storage unit 320, a user interface unit 330, and a data interface unit 340.

The electro-optical panel 200 is a matrix-type liquid-crystal display panel, for example. Alternatively, the electro-optical panel 200 may be an EL (Electro-Luminescence) display panel using selfluminous elements. The user interface unit 330 is an interface unit that accepts various operations from a user. The user interface unit 330 is constituted of buttons, a mouse, a keyboard, a touch panel with which the electro-optical panel 200 is equipped, or the like, for example. The data interface unit 340 is an interface unit that inputs and outputs image data, control data, and the like. For example, the data interface unit 340 is a wired communication interface such as USB, a wireless communication interface such as a wireless LAN, or the like. The storage unit 320 stores image data inputted from the data interface unit 340. Alternatively, the storage unit 320 functions as a working memory for the CPU 310, the display controller 300, or the like. The CPU 310 carries out control processing for the various units in the electronic device, various types of data processing, and so on. The display controller 300 carries out control processing for the driver 100. For example, the display controller 300 converts image data transferred from the data interface unit 340, the storage unit 320, or the like into a format that can be handled by the driver 100, and outputs the converted image data to the driver 100. The driver 100 drives the electro-optical panel 200 based on the image data transferred from the display controller 300.

Although the foregoing has described embodiments of the invention in detail, one skilled in the art will easily recognize that many variations can be made thereon without departing from the essential spirit of the novel items and effects of the invention. Such variations should therefore be taken as being included within the scope of the invention. For example, in the specification or drawings, terms denoted at least once along with terms that have broader or the same definitions as those terms ("low-level" and "high-level" for "first logic level" and "second logic level", respectively) can be replaced with those terms in all areas of the specification or drawings. Furthermore, all combinations of the embodiments and variations fall within the scope of the invention. Finally, the configurations and operations of the capacitor circuit, capacitor driving circuit, variable capacitance circuit, detection circuit, control circuit, driver, electro-optical panel, electronic device are not limited to those described in the embodiments, and many variations can be made thereon.

The entire disclosure of Japanese Patent Application No. 2014-210365, filed Oct. 15, 2014 is expressly incorporated by reference herein.

What is claimed is:

1. A driver comprising:

a capacitor driving circuit that outputs first to nth capacitor driving voltages (where n is a natural number of 2 or more) corresponding to tone data to first to nth capacitor driving nodes;

a capacitor circuit including first to nth capacitors provided between the first to nth capacitor driving nodes and a data voltage output terminal; and a variable capacitance circuit provided between the data voltage output terminal and a reference voltage node;

wherein a capacitance of the variable capacitance circuit is set so that a capacitance obtained by adding a capacitance of the variable capacitance circuit and an electro-optical panel-side capacitance is in a prescribed capacitance ratio relationship with a capacitance of the capacitor circuit.

2. The driver according to claim 1, wherein the capacitor driving circuit outputs a first voltage level or a second voltage level as each driving voltage of the first to nth capacitor driving voltages based on first to nth bits of the tone data; and the prescribed capacitance ratio relationship is determined by a voltage relationship between a voltage difference between the first voltage level and the second voltage level and the data voltages outputted to the data voltage output terminal.

3. The driver according to claim 1, further comprising:

a detection circuit that detects a voltage at the data voltage output terminal, wherein the capacitance of the variable capacitance circuit is set based on a detection result from the detection circuit.

4. The driver according to claim 1, wherein the variable capacitance circuit includes:

first to mth adjusting capacitors (where m is a natural number of 2 or more); and first to mth switching elements provided between the first to mth adjusting capacitors and the data voltage output terminal.

5. The driver according to claim 1, wherein in a reset period prior to capacitive driving that drives the electro-optical panel using the capacitor driving circuit and the capacitor circuit, the data voltage output terminal is set to a prescribed reset voltage, in a state in which the first to nth capacitor driving voltages corresponding to initial value data of the capacitor driving circuit are outputted.

6. The driver according to claim 5, further comprising:

a reset voltage amplifier circuit or a reset voltage terminal for setting the prescribed reset voltage.

7. The driver according to claim 5, wherein reset operations in the reset period are carried out in the case where data lines of the electro-optical panel are driven by driving aside from capacitive driving.

8. The driver according to claim 7, wherein the driving aside from capacitive driving is precharge driving that outputs a prescribed precharge voltage to the data lines.

9. The driver according to claim 8, further comprising:

a precharge amplifier circuit that carries out the precharge driving; and a precharge terminal, connected to an output of the precharge amplifier circuit, for connecting an external capacitor.

10. The driver according to claim 1, wherein charge redistribution is carried out among a capacitance of the first to nth capacitors, the capacitance of the variable capacitance circuit, and the electro-optical panel-side capacitance by the capacitor driving circuit outputting the first to nth capacitor driving voltages, and a data voltage corresponding to the tone data is outputted to the data voltage output terminal.

11. The driver according to claim 1, further comprising:

first to kth data line driving circuits (where k is a natural number of 2 or more) in which each data line driving circuit has the capacitor driving circuit, the capacitor circuit, and the variable capacitance circuit; and first to kth data voltage output terminals connected to outputs of the first to kth data line driving circuits, wherein the electro-optical panel includes:

first to kth data lines connected to the first to kth data voltage output terminals;

$(j-1)\times k+1$th to $j\times k$th source lines (where j is a natural number less than or equal to s, and s is a natural number of 2 or more); and $(j-1)\times k+1$ to $j\times k$th switching elements provided between the first to kth data lines and the $(j-1)\times k+1$th to $j\times k$th source lines, and wherein after first to kth switching elements (j=1) have turned on and the first to kth data line driving circuits have driven first to kth source lines, k+1th to $2\times k$th switching elements (j=2) turn on and the first to kth data line driving circuits drive k+1th to $2\times k$th source lines.

12. An electronic device comprising the driver according to claim 1.

13. An electronic device comprising the driver according to claim 2.

14. An electronic device comprising the driver according to claim 3.

15. An electronic device comprising the driver according to claim 4.

16. An electronic device comprising the driver according to claim 5.

17. An electronic device comprising the driver according to claim 6.

18. An electronic device comprising the driver according to claim 7.

19. An electronic device comprising the driver according to claim 8.

20. An electronic device comprising the driver according to claim 9.

* * * * *